US012723505B2

(12) United States Patent
Case et al.

(10) Patent No.: US 12,723,505 B2
(45) Date of Patent: Sep. 1, 2026

(54) APPARATUS, SYSTEM, AND METHODS FOR COUPLING TOOLS TO DRILL RIGS

(71) Applicant: VERACIO LTD., Salt Lake City, UT (US)

(72) Inventors: Michael Case, Milton (CA); Adam Tomaszewski, Mississauga (CA); Anthony Lachance, Burlington (CA)

(73) Assignee: Veracio Ltd., Salt Lake City, UT (US)

( * ) Notice: Subject to any disclaimer, the term of this patent is extended or adjusted under 35 U.S.C. 154(b) by 89 days.

(21) Appl. No.: 18/838,885

(22) PCT Filed: Feb. 16, 2023

(86) PCT No.: PCT/US2023/013206
§ 371 (c)(1),
(2) Date: Aug. 15, 2024

(87) PCT Pub. No.: WO2023/158734
PCT Pub. Date: Aug. 24, 2023

(65) Prior Publication Data

US 2025/0154863 A1 May 15, 2025

Related U.S. Application Data

(60) Provisional application No. 63/310,661, filed on Feb. 16, 2022.

(51) Int. Cl.
*E21B 47/024* (2006.01)
*E21B 47/01* (2012.01)

(52) U.S. Cl.
CPC ..... *E21B 47/024* (2013.01); *E21B 47/01* (2013.01)

(58) Field of Classification Search
CPC ..... E21B 47/024; E21B 47/01
See application file for complete search history.

(56) References Cited

U.S. PATENT DOCUMENTS 2,767,989 A 10/1956 Luebbers
4,998,082 A 3/1991 Duimstra
(Continued)

FOREIGN PATENT DOCUMENTS

AU 2015100244 4/2015
CS 238227 11/1985
(Continued)

OTHER PUBLICATIONS

International Search Authority Search Report and Written Opinion for corresponding PCT Application No. PCT/US23/13206, dated May 23, 2023.

*Primary Examiner* — Anita M King
(74) *Attorney, Agent, or Firm* — Ballard Spahr LLP

(57) ABSTRACT

An apparatus having a unit that is attachable to a mounting platform, which has a first longitudinal axis. The mounting platform can include a base defining a first coupling feature. A latch can be movably coupled to the base about and between a secured position and a release position, the latch defining a first retention feature. The unit can have a second longitudinal axis and a second coupling feature that extends along the second longitudinal axis. The second coupling feature can be configured for engagement with the first coupling feature by movement of the second coupling feature relative to the first coupling feature along the first longitudinal axis. Engagement between the first and second coupling features can be configured to inhibit movement of the second coupling feature relative to the first coupling feature along an axis that is perpendicular to the first longitudinal axis.

20 Claims, 17 Drawing Sheets

(56) References Cited

U.S. PATENT DOCUMENTS

| | | | | |
|---|---|---|---|---|
| 6,264,902 | B1 | 7/2001 | Howlett | |
| 6,311,789 | B1 * | 11/2001 | Saxman | E21B 19/18 175/57 |
| 7,012,495 | B2 | 3/2006 | Underwood et al. | |
| 7,350,587 | B2 * | 4/2008 | Springett | E21B 21/106 166/380 |
| 11,105,161 | B2 * | 8/2021 | Chau | E21B 7/046 |
| 11,591,862 | B2 * | 2/2023 | Hernandez | E21B 19/06 |
| 2012/0096935 | A1 | 4/2012 | Finke | |
| 2018/0105094 | A1 | 4/2018 | Cain | |
| 2022/0317548 | A1 * | 10/2022 | Sun | G03B 17/08 |

FOREIGN PATENT DOCUMENTS

| | | |
|---|---|---|
| WO | 2021/161106 | 8/2021 |
| WO | 2022/000417 | 1/2022 |

* cited by examiner

APPARATUS, SYSTEM, AND METHODS FOR COUPLING TOOLS TO DRILL RIGS

CROSS-REFERENCE TO RELATED APPLICATION

This application is a national phase filing under 35 U.S.C. § 371 of International Application No. PCT/US2023/013206, filed Feb. 16, 2023, which claims priority to and the benefit of the filing date of U.S. Provisional Patent Application No. 63/310,661, filed Feb. 16, 2022, which are incorporated herein by reference in their entirety.

FIELD

The present disclosure relates to apparatuses, systems, and methods for coupling tools to drill rigs, such as, for example, tools for determining drill rig alignment.

BACKGROUND

Before, during, or after drilling, various tools (e.g., electronic tools) can be mounted to a drill rig or drill string for gathering data. Such tools can include, for example, azimuthal alignment tools and wireline depth measurement tools. Certain tools need to be held in particular alignments and can be heavy, so they must be securely held in place. Conventional means for securing these tools are either overly time consuming, insufficiently secure, or subject to improper positioning.

For example, drill rigs, such as those used in underground mining, require alignment in order to orient the drill rig to drill toward a target drilling location. In particular, the azimuth of the drill rig can be difficult to determine. Magnetic compasses can be used, but they lack sufficient accuracy and can be subject to magnetic interference from equipment or surrounding ore. To provide improved accuracy, surveyors can assist with the drill rig alignment. However, surveying is an expensive and time intensive process. Some alignment devices are coupled to an exterior of a drill rod that is held in the chuck of the drill rig. However, these devices are subject to error from the clamping means causing the devices to be offset from a central axis of the drill rod.

SUMMARY

Described herein, in various aspects, is an apparatus comprising a mounting platform having a first longitudinal axis. The mounting platform can comprise a base defining a first coupling feature. A latch can be movably coupled to the base about and between a secured position and a release position. The latch can define a first retention feature. A unit can be attachable to the mounting platform. The unit can have a second longitudinal axis. The unit can comprise a second coupling feature that extends along the second longitudinal axis. The second coupling feature can be configured for engagement with the first coupling feature by movement of the second coupling feature relative to the first coupling feature along the first longitudinal axis. Engagement between the first and second coupling features can be configured to inhibit movement of the second coupling feature relative to the first coupling feature along an axis that is perpendicular to the first longitudinal axis. A second retention feature can be configured to cooperate with the first retention feature to inhibit movement of the second retention relative to the first retention feature along the axis that is perpendicular to the first longitudinal axis.

Systems and methods for use of the apparatus are also disclosed.

Additional advantages of the invention will be set forth in part in the description that follows, and in part will be obvious from the description, or may be learned by practice of the invention. The advantages of the invention will be realized and attained by means of the elements and combinations particularly pointed out in the appended claims. It is to be understood that both the foregoing general description and the following detailed description are exemplary and explanatory only and are not restrictive of the invention, as claimed.

DESCRIPTION OF THE DRAWINGS

These and other features of the preferred embodiments of the invention will become more apparent in the detailed description in which reference is made to the appended drawings wherein.

DETAILED DESCRIPTION

Figure 1:
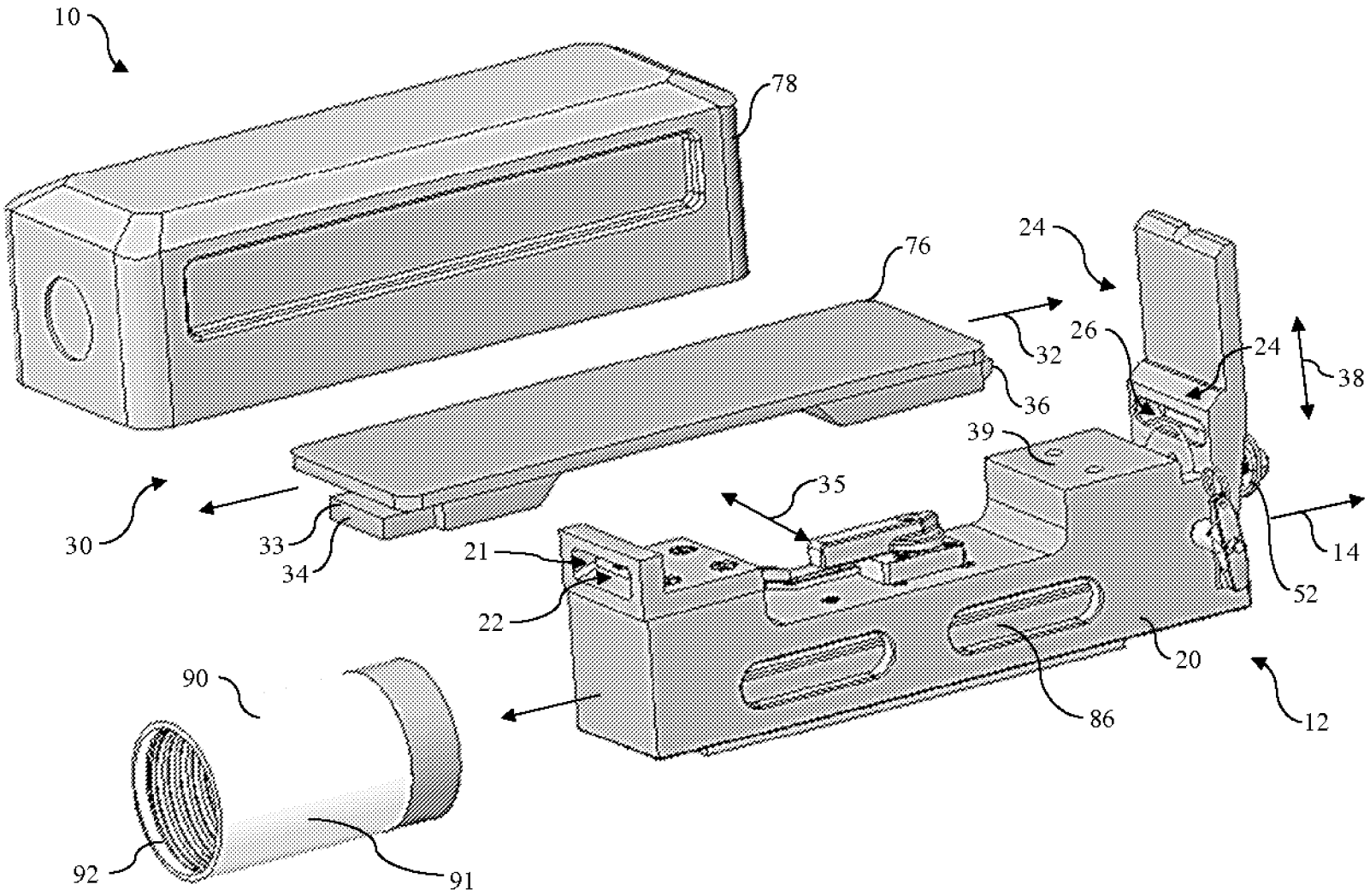
FIG. 1 is an exploded view of an apparatus for aligning a drill rig in accordance with embodiments disclosed herein.

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a," "an," and "the" include plural referents unless the context clearly dictates otherwise. For example, use of the term "a protrusion" can refer to one or more of such protrusions, and so forth.

All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 15%, up to 10%, up to 5%, or up to 1% (above or below) of the particularly stated value can be included within the scope of those aspects. Similarly, in some optional aspects, when values are approximated by use of the terms "substantially" or "generally," it is contemplated that values within up to 15%, up to 10%, up to 5%, or up to 1% (above or below) of the particular value can be included within the scope of those aspects. When used with respect to an identified property or circumstance, "substantially" or "generally" can refer to a degree of deviation that is sufficiently small so as to not measurably detract from the identified property or circumstance, and the exact degree of deviation allowable may in some cases depend on the specific context.

As used herein, the terms "optional" or "optionally" mean that the subsequently described event or circumstance may or may not occur, and that the description includes instances where said event or circumstance occurs and instances where it does not.

As used herein, the term "at least one of" is intended to be synonymous with "one or more of." For example, "at least one of A, B and C" explicitly includes only A, only B, only C, and combinations of each.

The word "or" as used herein can mean any one member of a particular list and, except where the context indicates otherwise, can also include any combination of members of that list.

It is to be understood that unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; and the number or type of aspects described in the specification.

The following description supplies specific details in order to provide a thorough understanding. Nevertheless, the skilled artisan would understand that the apparatus, system, and associated methods of using the apparatus can be implemented and used without employing these specific details. Indeed, the apparatus, system, and associated methods can be placed into practice by modifying the illustrated apparatus, system, and associated methods and can be used in conjunction with any other apparatus and techniques conventionally used in the industry.

Coupling Apparatus

Figure 2:
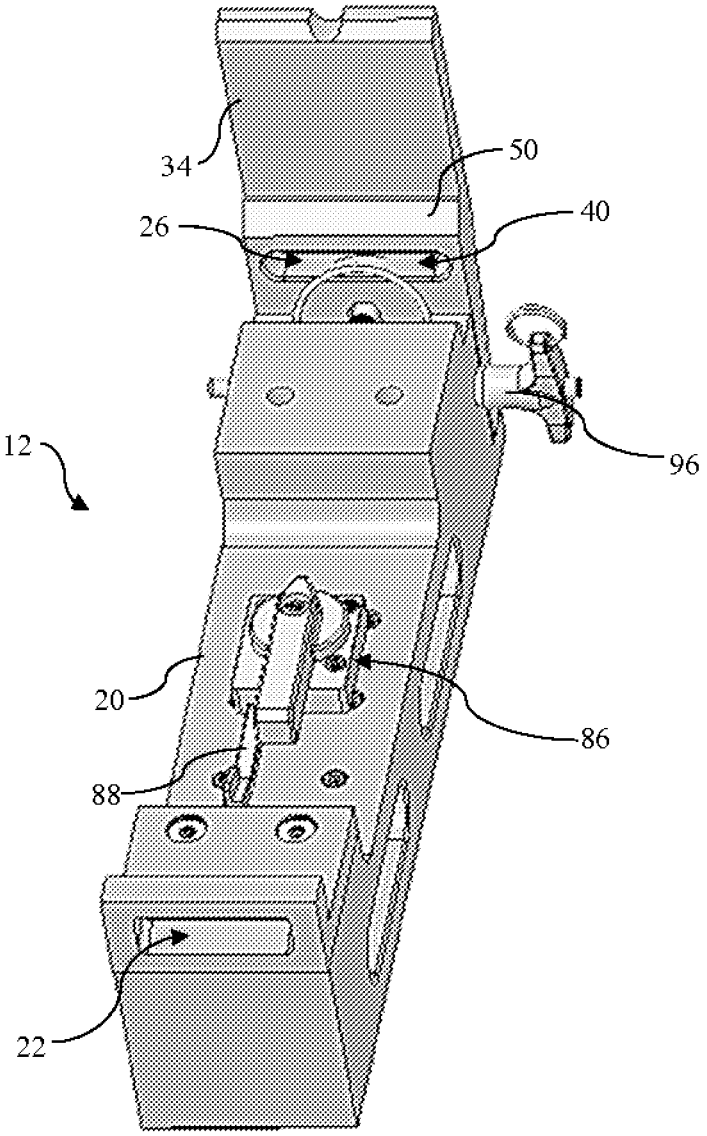
FIG. 2 is a perspective view of a mounting platform of the apparatus of FIG. 1.
Figure 3:
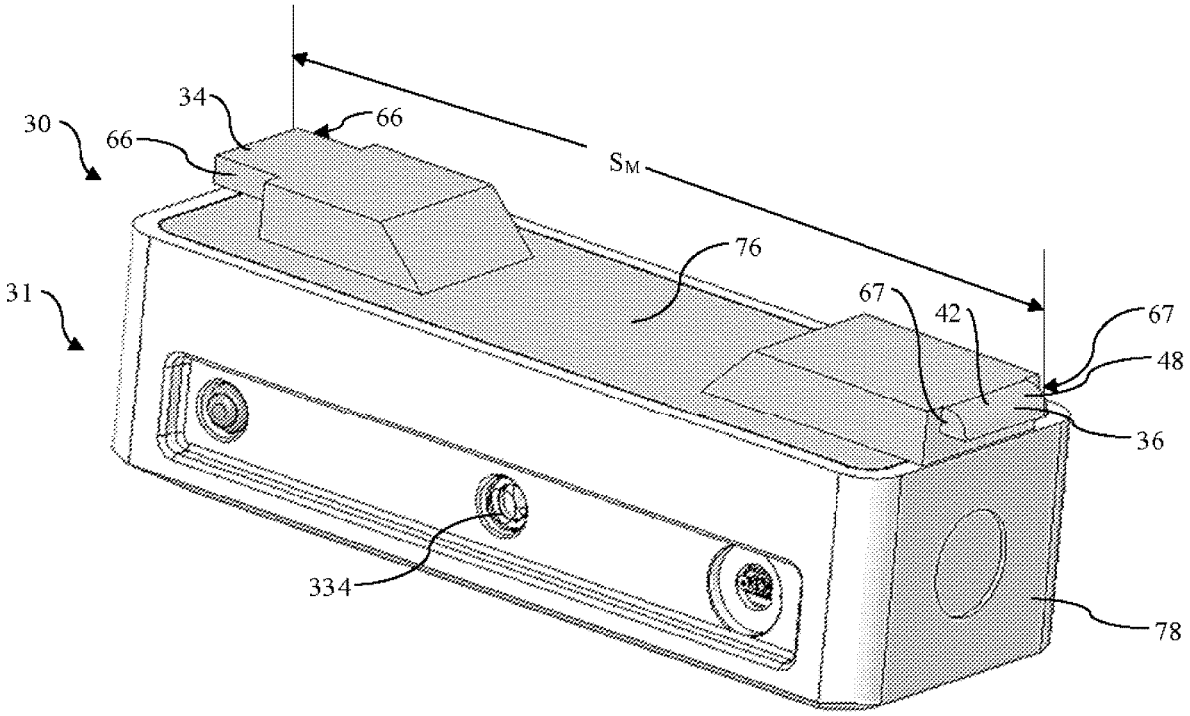
FIG. 3 is a perspective view of a unit that is configured to couple to the mounting platform of FIG. 2.
Figure 6:
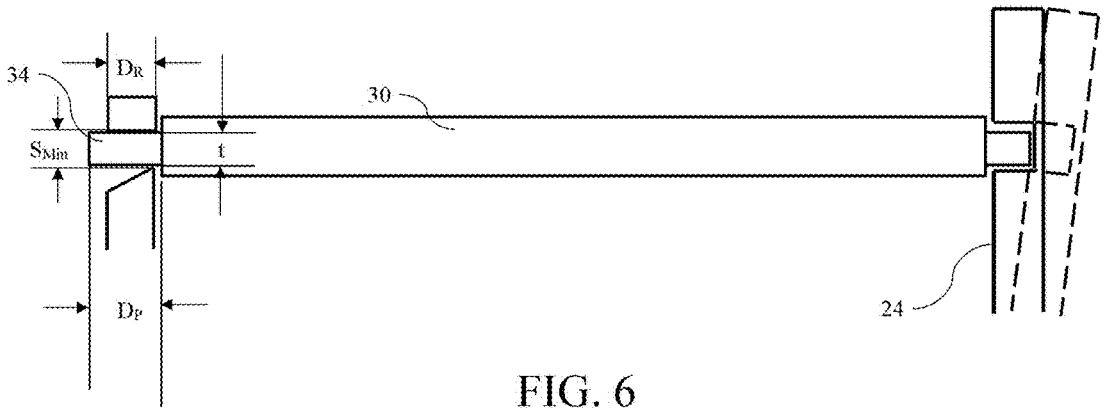
FIG. 6 is schematic diagram of an exemplary mounting platform as disclosed herein with a latch shown in secured and release positions and with an exemplary unit showing in a first position.

Disclosed herein with reference to FIGS. 1-3 is an apparatus 10 for aligning a drill rig. The apparatus 10 can comprise a mounting platform 12 having a first longitudinal axis 14. The mounting platform 12 can comprise a base 20 that defines a first coupling feature 21. The first coupling feature 21 can be, for example, a first receptacle 22. The base 20 can comprise a latch 24 that is movably coupled to the base 20 about and between a secured position (FIG. 6 in solid lines) and a release position (FIG. 6 in broken lines). The latch 24 can define a first retention feature 26, which can optionally comprise a second receptacle 40 as shown in FIG. 2.

A unit 30 can be attachable to the mounting platform 12. The unit can have a second longitudinal axis 32. The unit 30 can comprise, for example, circuitry and/or hardware components for measuring and communicating azimuthal information. In further aspects, the unit can comprise circuitry and/or hardware components for use as a wireline depth counter. However, it should be understood that embodiments disclosed herein can be advantageously used in various applications.

The unit 30 can comprise a second coupling feature 33. The second coupling feature 33 can be, for example, a first protrusion 34 that extends along the second longitudinal axis 32. The first protrusion 34 can be receivable into the first receptacle 22. The unit 30 can further comprise a second retention feature 36 that is configured to cooperate with the first retention feature 26 to inhibit movement of the first retention feature relative to the second retention feature along an axis 38 that is perpendicular to the first longitudinal axis 14. The axis 38 can further be perpendicular to a mounting surface 39 upon which a portion of the unit 30 can seat (e.g., rest) when coupled to the mounting platform 12. Similarly, the first and second retention features 26, 36 can be configured to inhibit movement of the first retention feature relative to the second retention feature along a transverse axis 35 that is perpendicular to the second longitudinal axis 32 and to the axis 38.

Figure 12C:
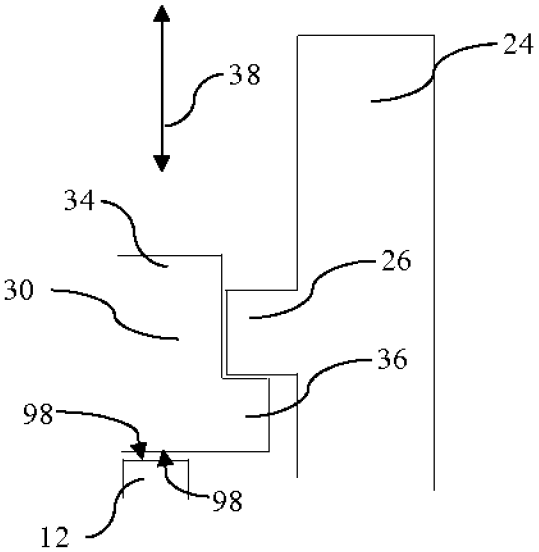
FIG. 12C is a schematic diagram of yet another exemplary set of first and second retention features as disclosed herein.
Figure 12B:
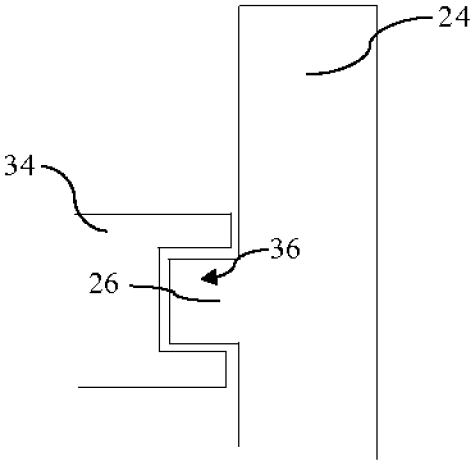
FIG. 12B is a schematic diagram of another exemplary set of first and second retention features as disclosed herein.
Figure 12A:
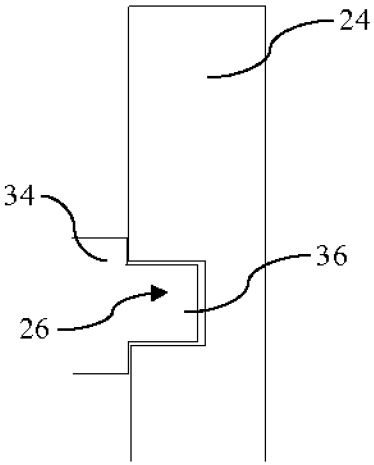
FIG. 12A is a schematic diagram of an exemplary set of first and second retention features as disclosed herein.

For example, in some aspects and with further reference to FIGS. 1-3 and FIG. 12A, the first retention feature 26 can comprise a second receptacle 40, and the second retention feature 36 can comprise a second protrusion 42 that is receivable into the second receptacle. With the second protrusion 42 received within the second receptacle 40, the unit 30 at the second protrusion cannot move along the axis 38. The second receptacle 40 can extend partially or entirely through the latch 24. Alternatively, in further aspects and with reference to FIG. 12B, the first retention feature 26 can be a protrusion, and the second retention feature 36 can be a receptacle that is configured to receive the protrusion. Alternatively, in still further aspects and with reference to FIG. 12C, the first retention feature 26 can comprise a male protrusion that is configured to extend over a portion of the unit 30 (the second retention feature 36) so that the first retention feature inhibits movement of the second retention feature in a first direction along the axis 38. Optionally, a second set of meeting surfaces 98 of the mounting platform 12 and unit 30 positioned elsewhere can inhibit movement of the second retention feature 36 in an opposed second direction along the axis 38.

It is contemplated that the first and second coupling features 21, 33 can be any respective structures that permit engagement with each other (e.g., complementary receipt of one into the other) by sliding the unit 30 relative to the mounting platform 12 along the first longitudinal axis 14 and, when in engagement, inhibit relative movement between the first and second coupling features along the axis 38. As used herein, movement "along" a particular axis can, in some aspects, include movement parallel to or in alignment with said particular axis and, unless context dictates otherwise, can also include movement having a directional component along said particular axis (e.g., movement in a direction oblique to the particular axis that has a directional component along the particular axis and at least one additional directional component along a different axis (see FIG. 8)). The first and second coupling features 21, 33 can, when in engagement, permit some amount of pivotal movement of the unit relative to the mounting platform to allow for engagement and disengagement between the first and second coupling features. Thus, although the illustrated embodiments show the first and second coupling features 21, 33 as a first receptacle 22 and a first protrusion 34, further embodiments are contemplated. For example, in further aspects, the first coupling feature can comprise a protrusion, and the second coupling feature 33 can comprise a receptacle that is configured to receive the protrusion of the first coupling feature. In yet further aspects, the mounting platform 12 can comprise a T-shaped structure that serves as the first retention feature 21, and the unit 30 can comprise a structure (e.g., a forked pair of prongs) that is configured to mate with the T-shaped structure (and serves as the second retention feature 33).

Thus, the unit 30 can be mounted to the mounting platform 12 by engagement between the first and second coupling features 21, 33 (e.g., by receipt of the first protrusion 34 in the first receptacle 22) and engagement of the first retention feature 26 with the second retention feature 36. For example, the first protrusion 34 can be inserted into the first receptacle 22. The unit 30 can be pivoted relative to the mounting platform 12 to move the second retention feature (e.g., second protrusion 42) toward and into the second receptacle 40.

The latch 24 can be pivotably coupled to the base 20 about and between the secured position and the release position. In further optional aspects, the latch can be slidable or otherwise movable relative to the body 20 along the first longitudinal axis 14. A biasing element 46 (FIG. 10), such as, for example, a spring, can bias the latch 24 toward the secured position. The spring can bias against an outer side of the latch opposite the first receptacle 22.

The second protrusion 42 and or the latch can comprise surfaces that urge the latch 24 toward the release position as the unit 30 is pivoted relative to the mounting platform 12 to move the second protrusion 42 toward and into the second receptacle 40. For example, and with reference to FIG. 3, the second protrusion 42 can define a curved surface 48 that meets a sloped surface 50 (FIG. 2) of the latch 24.

Figure 4:
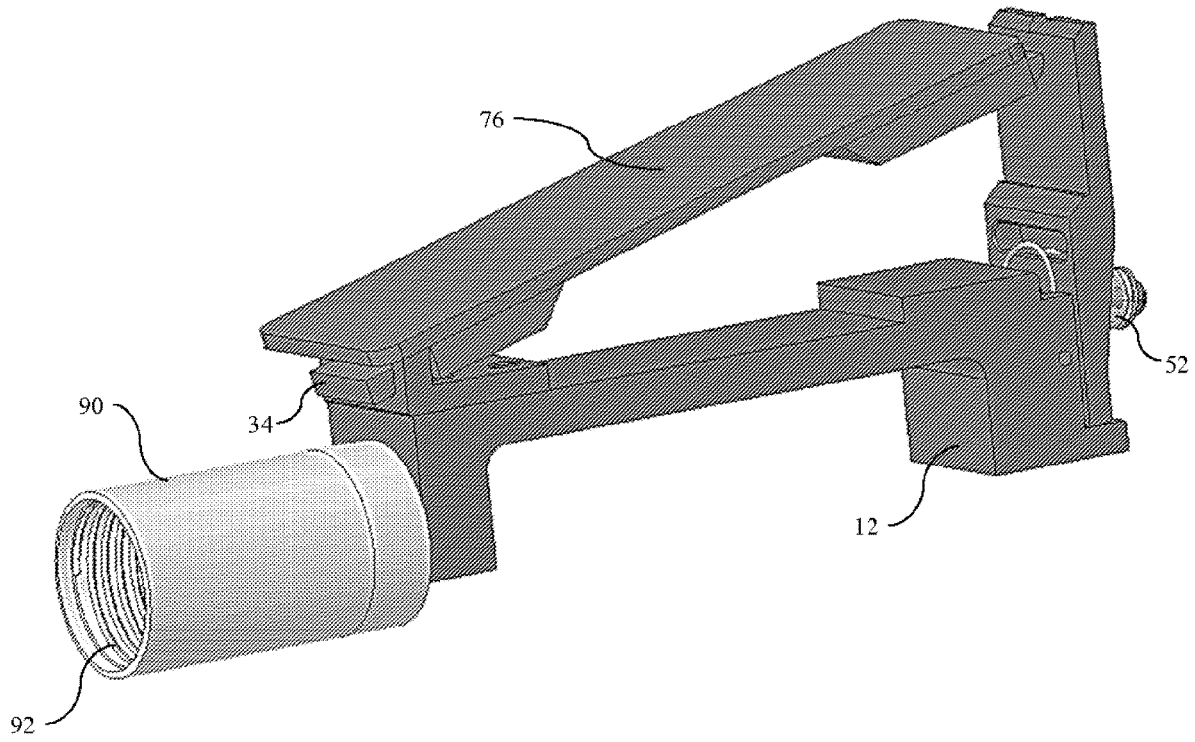
FIG. 4 is a perspective view of an exemplary mounting platform and at least a portion of a unit that is configured to couple to the mounting platform.

The release position can be defined as a maximum movement (e.g., pivotal movement) from the secure position. This maximum movement can be limited (e.g., by a stop surface 52 such as shown in FIGS. 1 and 4). It is contemplated that, in some optional embodiments, the latch 24 need not be pivoted fully to the release position in order to release the unit 30 and permit removal from the mounting platform 12.

The apparatus 10 can be configured to inhibit inadvertent release of the unit, for example if jostling or weight of the unit 30 causes the latch 24 to move from the secured to the release position. According to one aspect, movement of the latch 24 from the secured position to the release position can move the first retention 26 feature along the first longitudinal axis 14 by a release distance D. With the latch 24 in the secured position, the first coupling feature 21 can overlap with the second coupling feature 33 along the first longitudinal axis 14 by an overlap distance Do that is greater than the release distance D. For example, the first protrusion 34 can have a protrusion distance $D_p$ along the second longitudinal axis. The protrusion distance can be greater than the release distance D. Thus, the first protrusion 34 can be inserted into the first receptacle 22 by a greater distance than release distance D (the distance that the first retention feature 26 can move). Accordingly, undesired movement of the latch 24 from the secured position to the release position with the second retention feature 36 engaged with the first retention feature 26 does not cause a distal end 54 of the first protrusion 34 to be fully removed from the first receptacle 22. In this way, undesired release of the unit 30 from the mounting platform 12 can be inhibited or prevented. In some aspects, and with reference to FIG. 7, the first protrusion 34 and the second retention feature 36 (e.g. second protrusion 42) can define a maximum spacing SM along the second longitudinal axis 32. With the latch 24 in the release position, the first receptacle 22 and the second retention feature 36 can define a removal spacing SR. For example, the removal spacing SR can be a minimum spacing between the second receptacle 40 and the first receptacle 22 (e.g., between openings of the second receptacle 40 and the first receptacle 22 that face each other). The maximum spacing SM between the first protrusion and the second retention feature can be greater than the removal spacing SR. In this way, even if the latch 24 is inadvertently moved to the release position (e.g., due to a jolt or the weight of the unit 30), due to the maximum spacing SM being greater than the removal spacing SR, the first protrusion 34 is not fully removed from the first receptacle 22, and the unit 30 will not undesirably fall from the mounting platform 12. Rather, with the latch 24 in the release position, a user can manually move the unit 30 in a direction from the second retention feature 36 to the first protrusion 34 to disengage the second retention feature from the first retention feature 26. Then, the unit 30 can be pivoted relative to the mounting platform (e.g., moving the first retention feature 26 relative to the second retention feature 36 along the axis 38).

Figure 7:
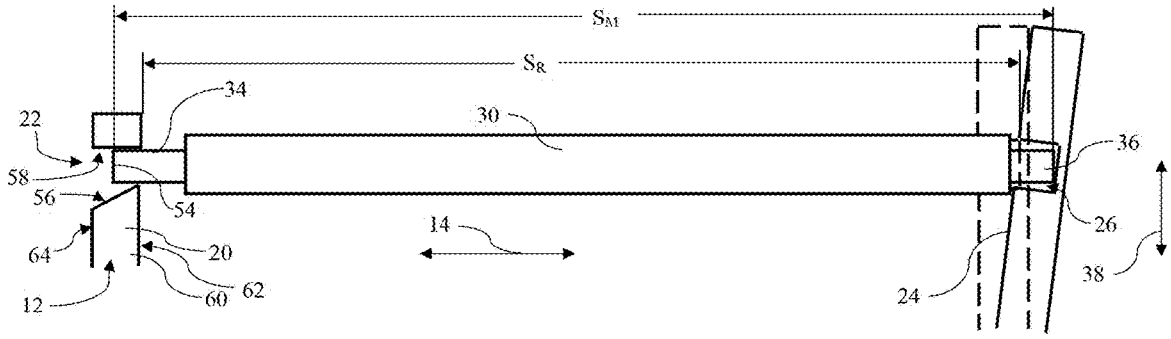
FIG. 7 is schematic diagram of the exemplary mounting platform of FIG. 6 with a latch shown in secured and release positions and with the exemplary unit showing in a second position.

In some aspects, and with reference to FIG. 7, the first receptacle 22 can comprise opposing first and second surfaces 56, 58. The opposing first and second surfaces 56, 58 can be spaced along the axis 38 that is perpendicular to the first longitudinal axis 14. The first surface 56 can form an acute angle with the first longitudinal axis 14. The acute angle can be, for example, from about 5 degrees to about 45 degrees, or from about 10 degrees to about 30 degrees, or about 15 degrees. The acute angle can be sufficient to permit the unit 30 to pivot sufficiently from the base 20 to enable the unit to be pulled away from the base without getting caught by the latch 24.

Accordingly, the first and second surfaces 56, 58 can increase in spacing from each other moving along the first longitudinal axis 14 in a direction from the first retention feature 26 to the first receptacle 22.

Figure 8:
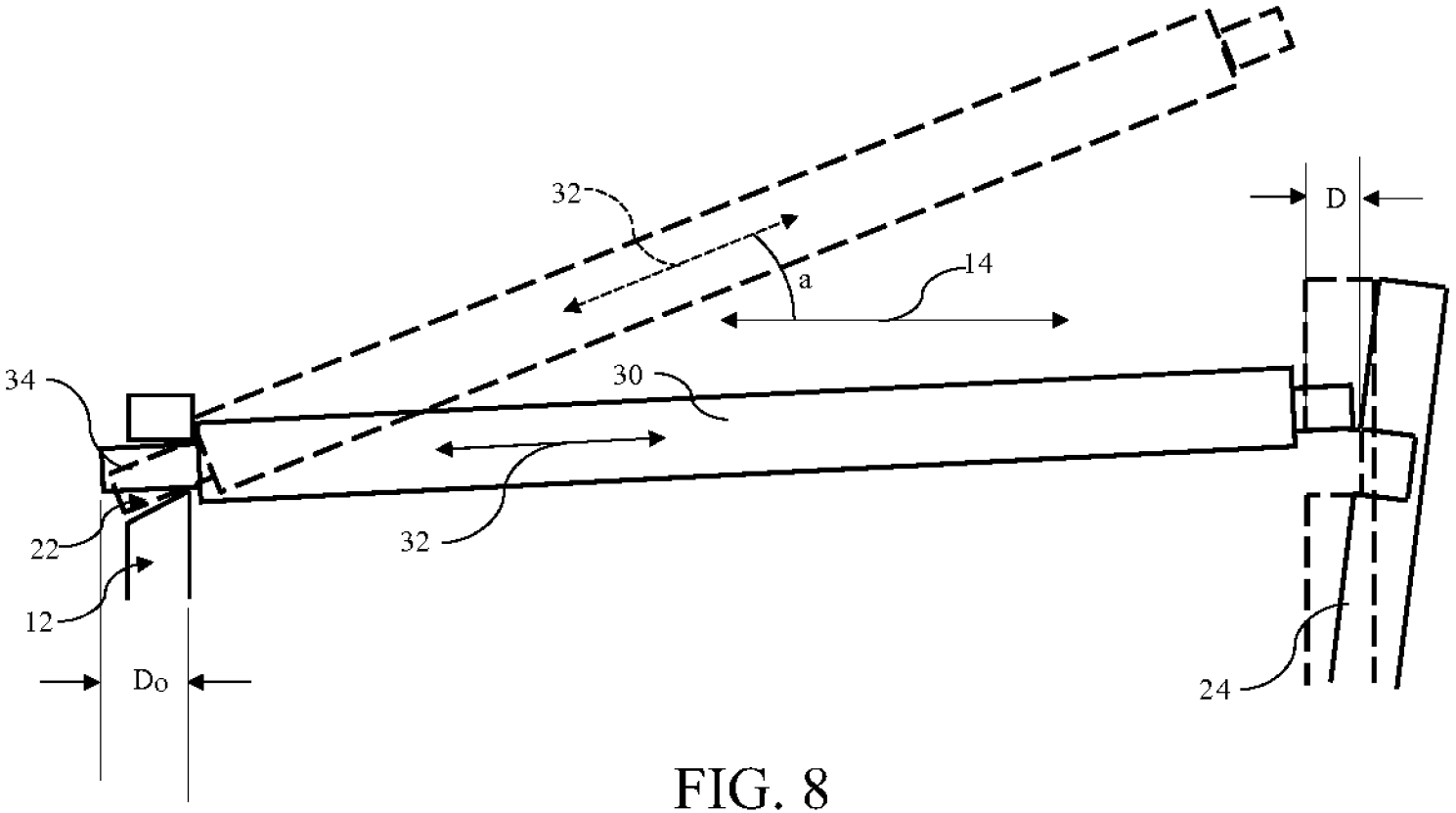
FIG. 8 is schematic diagram of an exemplary mounting platform of FIG. 6 with a latch shown in secured and release positions and with an exemplary unit showing in a third position.

In this way, as shown in FIG. 8, the first receptacle 22 can permit receipt of the first protrusion 34 therein with the second axis 32 oriented at an acute angle a relative to the first longitudinal axis 14, and the unit 30 can then be pivoted relative to the mounting platform 12 until the first engagement feature 26 engages the second engagement feature 36. As can be understood, because the first protrusion 34 cannot be removed from the first receptacle 22 with the first engagement feature 26 engaging the second engagement feature 36, the first receptacle 22 can permit pivotal movement of the unit 30 with the first protrusion 34 received therein.

In exemplary aspects, and with reference to FIG. 6, to minimize or eliminate slop (e.g., movement along the axis 38) between the unit 30 and the mounting platform 12 along the axis 38, the first and second surfaces 56, 58 can define a minimum spacing $S_{min}$ along the axis 38, and first protrusion 34 can, at a position along the second longitudinal axis 32 that engages the first and second surfaces when the latch 24 is in the secure position, have a thickness t along the axis 38 that is substantially equal to the minimum spacing $S_{min}$ between the first and second surfaces 56, 58 (allowing for clearance as necessary).

Figure 9:
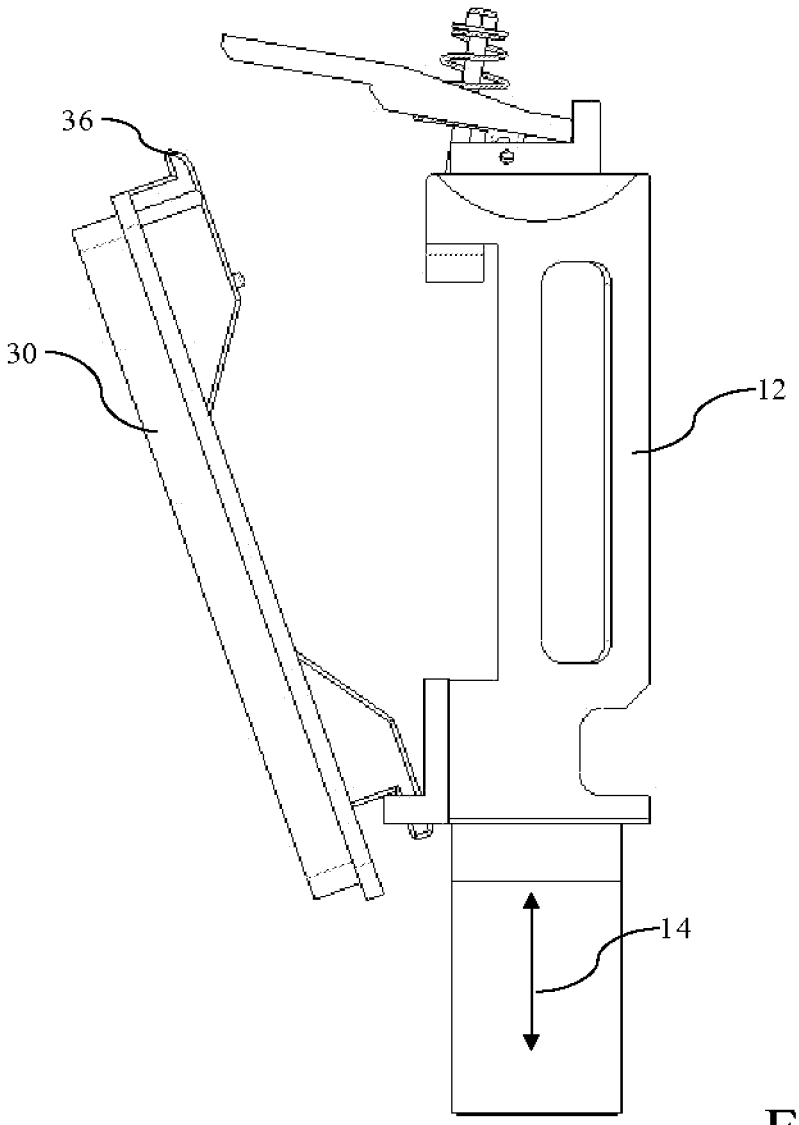
FIG. 9 is a side view of an exemplary coupling apparatus as disclosed herein, wherein the coupling apparatus has a mounting platform and a unit supported by the mounting platform, wherein the mounting platform has a longitudinal axis that is vertically oriented, wherein the mounting platform is supporting the unit by a protrusion of the unit being received in a receptacle.

Referring also to FIGS. 6-7 and 9, in some aspects, with the first longitudinal axis 14 oriented vertically and the second retention feature 36 is disengaged from the first retention feature 26, the engagement between the first protrusion 34 and the first recess 22 can prevent the first protrusion from falling from the first recess. For example, in some aspects, and with reference to FIG. 7, the mounting platform 12 can comprise a body 60 having opposed first and second sides 62, 64. In some optional aspects, the first receptacle 22 can be a through-opening that extends between the opposed first and second surfaces 62, 64 of the body 60. The opposed first and second surfaces 62, 64 of the body 60 can be spaced along the first longitudinal axis 14 by a first receptacle depth. As shown in FIG. 6, the first protrusion 34 can have a protrusion distance $D_p$ along the second longitudinal axis 14. The protrusion distance $D_p$ can be greater than the first receptacle depth. In this way, the first protrusion 34 can extend through the first receptacle 22 beyond the second surface 64. In this way, with the first longitudinal axis 14 oriented vertically and the second retention feature 36 disengaged from the first retention feature 26, the engagement between the first protrusion 34 and the first recess 22 can prevent the first protrusion from falling from the first recess. In further aspects, the first and second retention features 21, 33 can cooperate to prevent the disengagement between the first and second retention features without an external force (e.g., an operator lifting the unit 30). For example, the first protrusion 34 can extend sufficiently into the first recess 22 so that a rotational force due to the weight of the unit is counteracted by the engagement between the first protrusion and the first recess. In still further aspects, one of the first retention feature 21 or the second retention feature 33 can define a catch (e.g., a hooked surface) that catches the other of the first retention feature or the second retention feature to inhibit undesired release.

It is contemplated that when the unit 30 is coupled to the mounting platform 12, the unit can be in known alignment with the mounting platform. For example, the first and second longitudinal axes 14, 32 can be parallel when the unit 30 is coupled to the mounting platform 12. In this way, if the orientation of the mounting platform 12 is known, the orientation of the unit 30 can similarly be known.

In some aspects, and with reference to FIG. 3, laterally opposed sides 66 of the first protrusion 32 are spaced along a transverse axis 35 that is perpendicular to the second longitudinal axis 32. In these aspects, the laterally opposed sides 66 of the first protrusion 32 can cooperate with the interior surfaces of the first receptacle 22 to align a first end of the unit 30 with the mounting platform 12.

In some aspects, and with reference to FIG. 3, laterally opposed sides 67 of the second alignment feature can cooperate with corresponding surfaces of the first alignment feature to align a second end of the unit 30 with the mounting platform 12. In this way, the first longitudinal axis 14 can be aligned with the second longitudinal axis 32 (e.g., parallel to each other or in another known relationship relative to each other).

Figure 10:
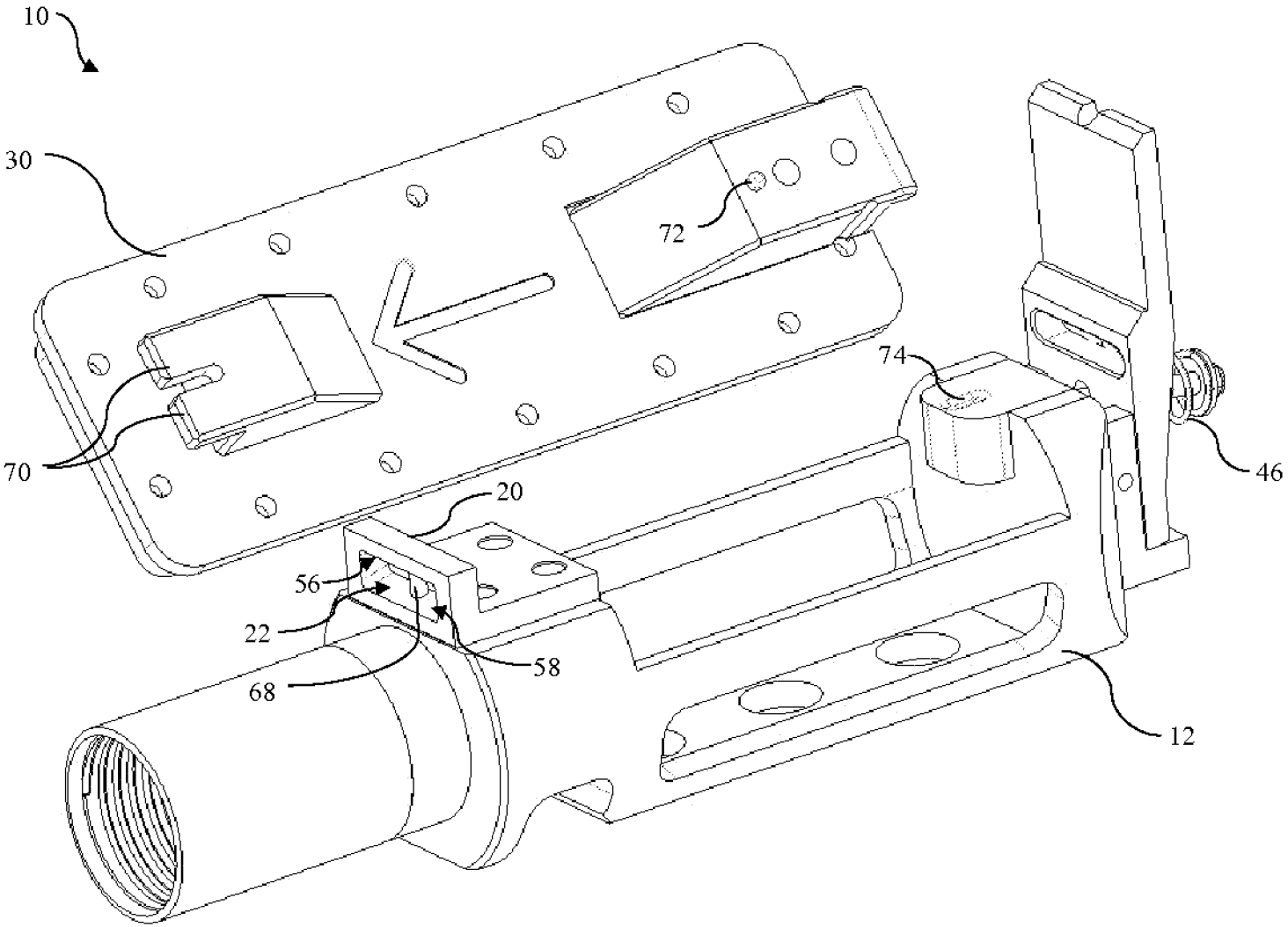
FIG. 10 is a perspective view of the exemplary coupling apparatus of FIG. 9, with the unit decoupled from the mounting platform.
Figure 11:
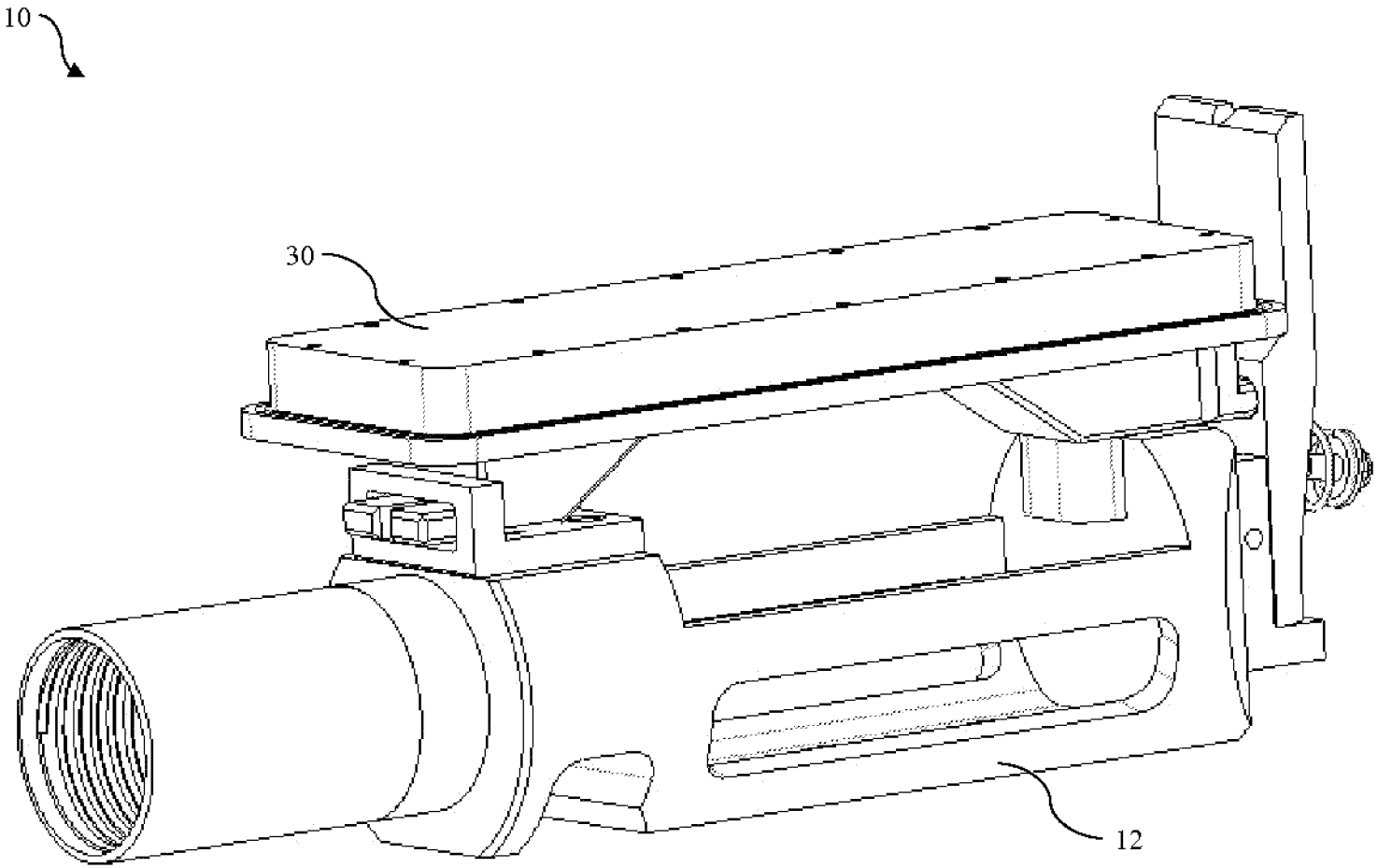
FIG. 11 is a perspective view of the exemplary coupling apparatus of FIG. 9, with the unit coupled to the mounting platform.

Referring also to FIGS. 10 and 11, in some aspects, the base 20 can comprise an alignment pin 68 that extends between the opposed first and second surfaces 56, 58 of the first receptacle 22. The first protrusion 34 can comprise spaced prongs 70 that are configured to receive the alignment pin 68 therebetween to align the first longitudinal axis 14 with the second longitudinal axis 32. For example, the receipt of the alignment pin 68 can align a first end of the unit 30 with the mounting platform 12 along the transverse axis 35.

In some aspects, the unit 30 can comprise an alignment pin 72 that is receivable into a slot 74 of the base 20. In this way, the second end of the unit 30 can be aligned with the mounting platform 12. The slot 74 can be elongate along the first longitudinal axis 14 in order to permit receipt of the alignment pin 72 into the slot in a pivotal motion.

Figure 5:
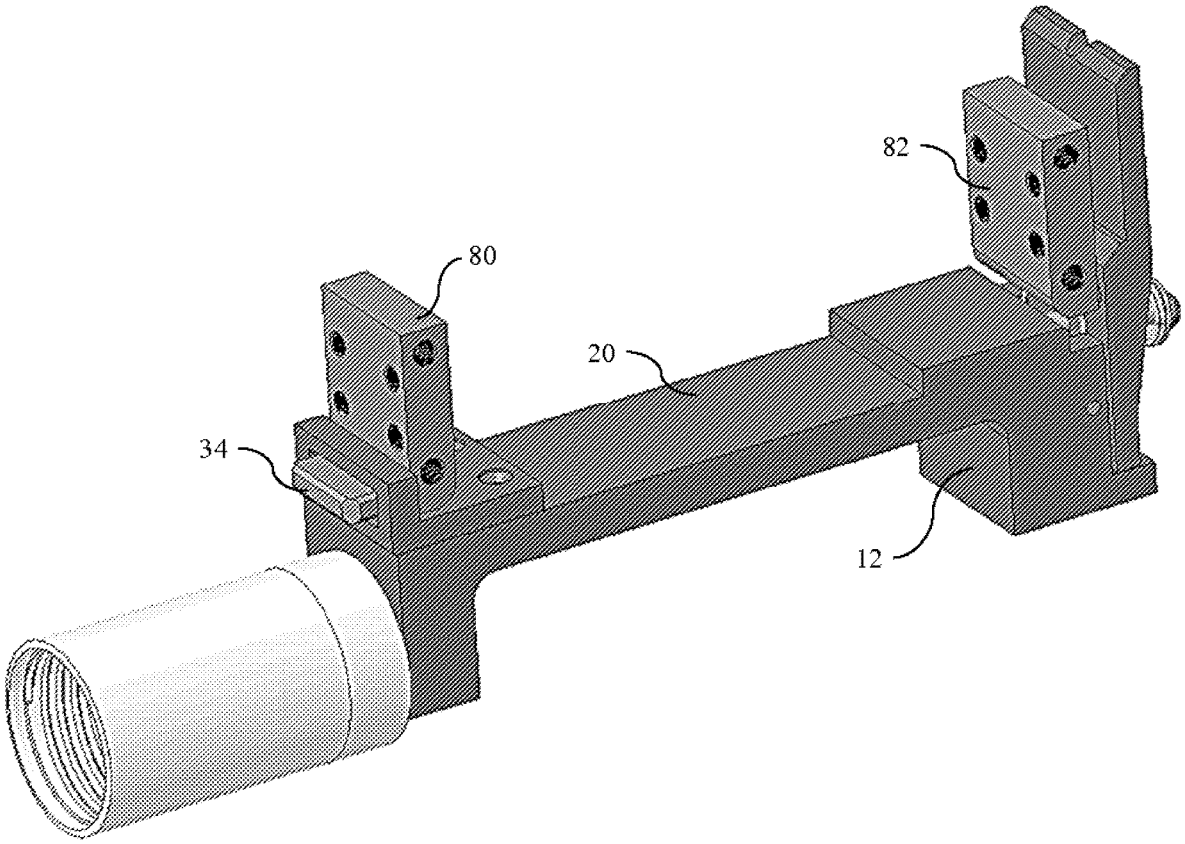
FIG. 5 is a perspective view of an exemplary mounting platform and portions of a unit that is configured to couple to the mounting platform.

Optionally, the unit 30 can comprise a unitary structure. In further aspects, and with reference to FIGS. 1 and 4, the unit 30 can comprise a cleat 76 that is configured to couple to the mounting platform 12, and a housing 78 can couple to the cleat. In still further aspects, and with reference to FIG. 5, the unit 30 (FIG. 1) can comprise a first component 80 that defines the first protrusion 34. The unit 30 can comprise a second component 82 that defines the second protrusion 42. A structure (e.g., the housing 78 (FIG. 1)) can couple to and extend between the first and second components 80, 82 to cooperatively define the unit (or a portion thereof).

In some aspects, the apparatus 10 can comprise a locking pin 96 that is configured to retain the latch 24 in the secured position. The locking pin 96 can extend through a bore in the base 20 and through an opening in the latch 24 that aligns with the bore in the base with the latch 24 in the secured position. The locking pin 90 can extend along the transverse axis 35 (e.g., parallel or generally parallel thereto).

The Coupling Apparatus as an Alignment Device

Referring to FIG. 9, the unit 30 can be an alignment device 31. For example, the alignment device 31 can comprise a gyroscopic orientation sensor 330 that is disposed within the housing 78. The gyroscopic orientation sensor 330 can be a microchip-packaged gyroscope (e.g., a microchip-packaged MEMS gyroscope). The gyroscopic orientation sensor 330 can be configured to provide a signal indicative of an orientation of the alignment device. In some aspects, the orientation of the alignment device can comprise an azimuth. As used herein, it should be understood that a gyroscopic orientation sensor can comprise one or a plurality of orientation sensing components that cooperate to generate one or more signals indicative of the orientation of the alignment device 31. In further aspects, the alignment device can comprise a plurality of gyroscopic orientation sensors 330. In some optional aspects, the gyroscopic orientation sensor 330 can be provided on an integrated circuit.

In some aspects, the alignment device 31 can be further configured to measure dip angle with respect to gravity. For example, the alignment device 31 can comprise one or more additional sensors, such as, for example, an accelerometer or other sensor for measuring dip angle (e.g., an angle between a drilling axis and a horizontal plane). The alignment device 31 can further comprise a temperature sensor. It is contemplated that measured temperature can be used to calibrate outputs of other sensors that vary with temperature. In some optional aspects, the alignment device 31 can comprise a global positioning system (GPS) tracker that can provide an output indicative of GPS coordinates. In further aspects, the alignment device 31 can further comprise a humidity sensor.

A wireless transmitter 332 can be in communication with (e.g., via direct or indirect, wired or wireless, connection) the gyroscopic orientation sensor 330. The wireless transmitter 332 can be configured to transmit a wireless output indicative of the orientation of the alignment device 31. It is contemplated that the housing 31 can comprise one or more windows 334 (FIG. 3) that enable wireless communication therethrough. Accordingly, it is contemplated that the one or more windows can be aligned with the wireless transmitter 332 at a particular location along the longitudinal axis 14 (such that an alignment axis can intersect the windows and the wireless transmitter 32.

In some aspects, it is contemplated that the transmitter 332 can transmit a wireless output, corresponding to the signal of the sensor, to a remote computing device 1001. In some optional aspects, the wireless output can be, for example, infrared (IR) frequency, radio frequency (e.g., Bluetooth or Wi-Fi,), or any other suitable wireless communication. In some aspects, the remote computing device 1001 can receive the wireless output from the transmitter 332 and process the signal to determine the orientation of the alignment device 31. In still further aspects, the transmitter 332 can comprise a wired transmitter such as, for example, a communication port (e.g. optionally, a RS-232 or universal serial bus port).

In further optional aspects, the alignment device can have an integral computing device that processes the signal from the sensor and determines the orientation of the alignment device. In these aspects, the alignment device can optionally transmit an orientation, such as, for example, an azimuthal angle (i.e., an angle representing the azimuth associated with an orientation of the alignment device), rather than a raw signal that requires further processing of the remote computing device 1001. For example, the alignment device 31 can comprise a computing device 340 comprising at least one processor 342 and a memory 344 in communication with the at least one processor. Optionally, it is contemplated that the computing device 340 can be configured in accordance with the configuration and architecture of the computing device 1001, further disclosed herein. However, it is contemplated that any computing device 340 having processing capabilities as disclosed herein can be used. The computing device 340 can be configured to receive the signal from the sensor and determine, based on the signal, the orientation of the device.

The alignment device 31 can comprise an electronics cradle for securing the internal components (e.g., gyroscopic orientation sensor 330, communication system, such as, for example, the wireless transmitter 332, battery, battery management system, etc.).

The alignment device 31 can comprise at least one indicator 350, such as, for example, an audible indicator (e.g., speaker) or visual indicator (e.g., LED, display, etc.). The indicator can provide an audible and/or visual indication to an operator corresponding to the orientation of the alignment device. For example, in some aspects, the indicator can be a display that outputs orientation data, such as, for example, azimuth and angles relative to horizontal axes.

In some aspects, the alignment device 31 can receive a user input (e.g., an alignment setting or desired orientation) from an operator. For example, the wireless transmitter 332 can be a transceiver that is in communication with the remote computing device 1001. The remote computing device can provide the desired orientation to the alignment device 31 via the transceiver. In some aspects, the desired orientation can comprise, or be embodied as, a desired azimuthal angle. The computing device 340 can be configured to compare the orientation of the alignment device 31 to the desired orientation. For example, the computing device 340 can calculate a difference between the desired azimuthal angle and a current orientation of the alignment device 31.

In some aspects, the indicator 350 can be configured to provide an indication of the difference between the desired azimuthal angle and the current orientation of the alignment device 31, this difference being referred to herein as the "azimuthal offset." In some aspects, the indicator can comprise an LED that changes color based on the proximity between the desired azimuthal angle and the current orientation of the alignment device 31. For example, green light (from the LED) can indicate an azimuthal offset of within +/−1 degree, yellow light can indicate an azimuthal offset within +/−10 degrees, and red light can indicate an azimuthal offset of greater than +/−10 degrees. As another example, an LED can be configured to flash at a frequency that changes based on the azimuthal offset (e.g., a flash frequency that increases as the azimuthal offset decreases). In various other aspects, the indicator can be a speaker, and the speaker can output a tone that changes frequency and/or volume based on the azimuthal offset or output a voice stating the azimuthal offset.

In further aspects, the alignment device 31 can comprise a battery 360 or other power source that can be configured to provide power to the gyroscopic orientation sensor 330, the wireless transmitter 332, computing device 340, and indicator 350.

Exemplary Methods of Use

Figure 14:
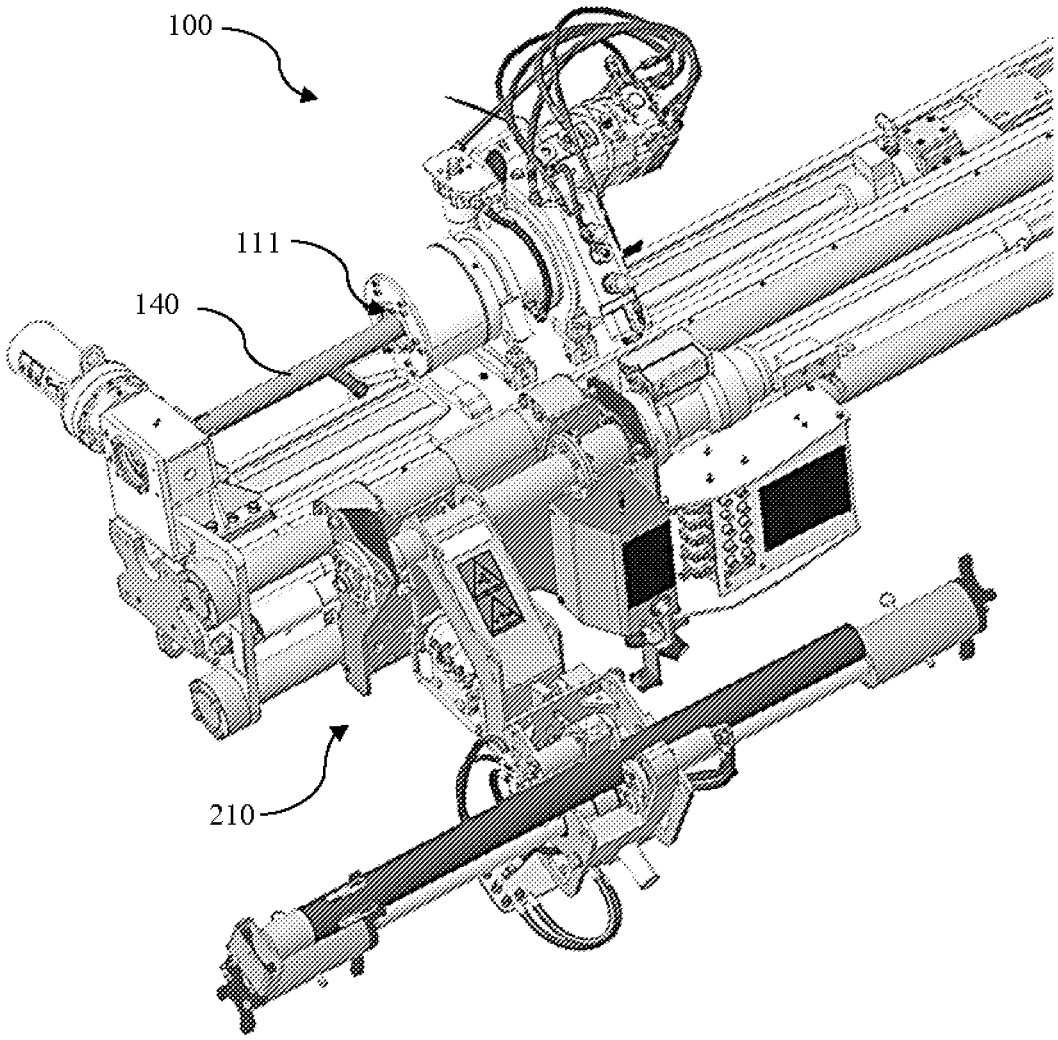
FIG. 14 is a perspective view of a chuck of a drill rig that can use the rig alignment device as disclosed herein.
Figure 15:
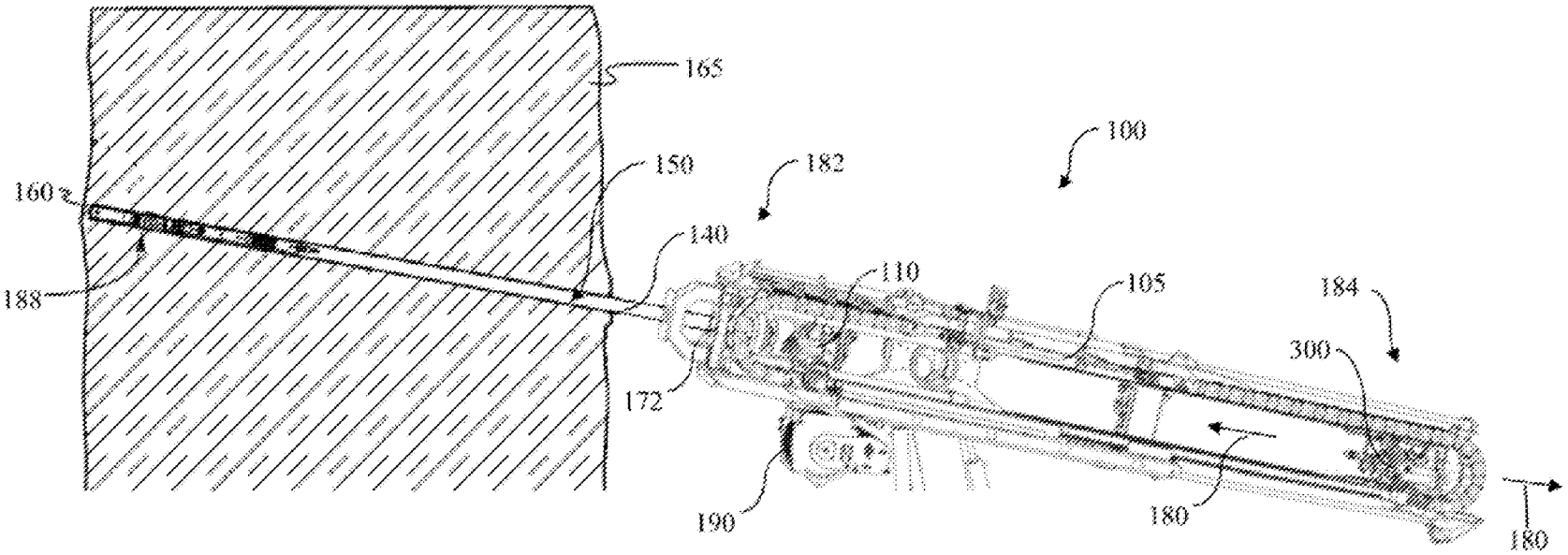
FIG. 15 is a side view of an underground drill rig drilling into a formation, in accordance with embodiments disclosed herein.
Figure 16:
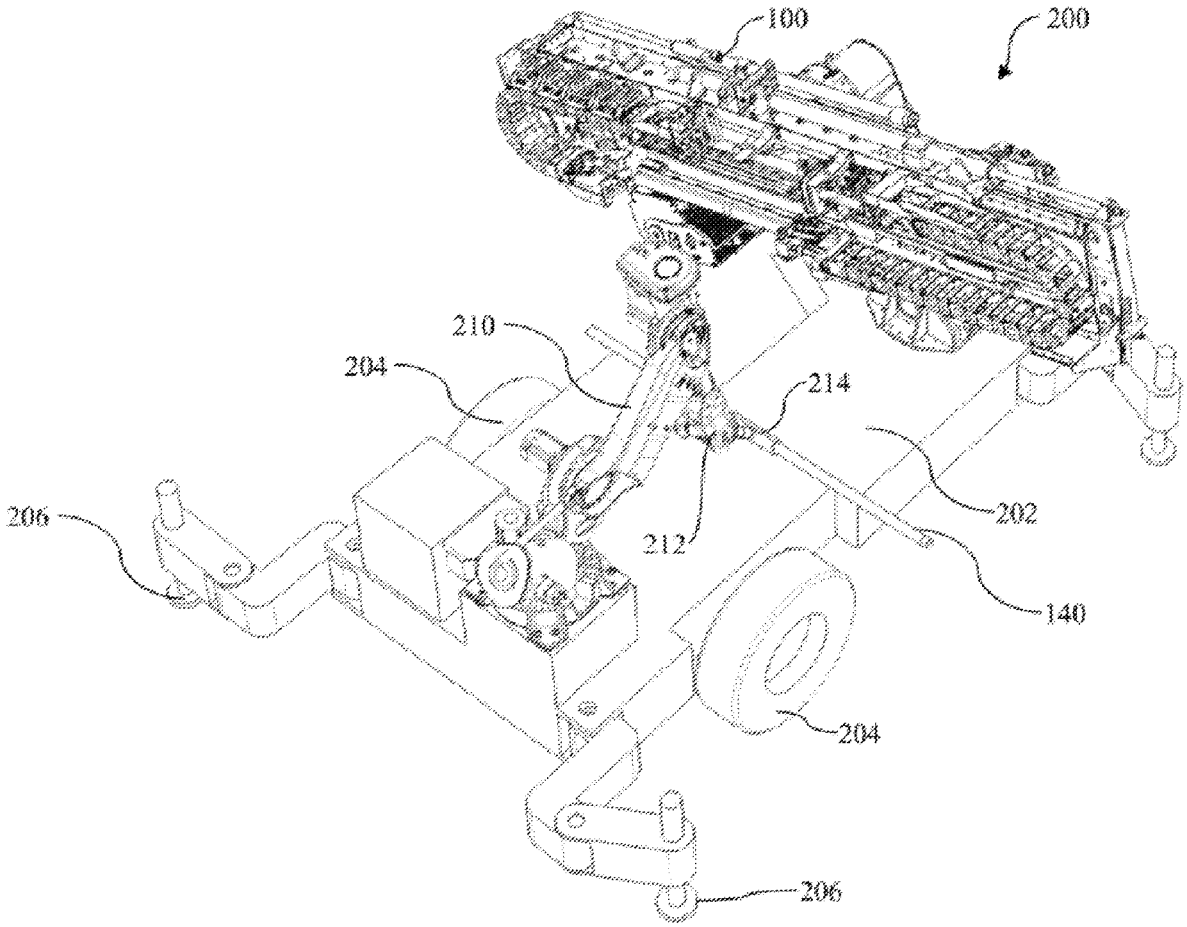
FIG. 16 is a rear perspective view of an exemplary underground drilling system comprising a drill rig of FIG. 15.
Figure 17:
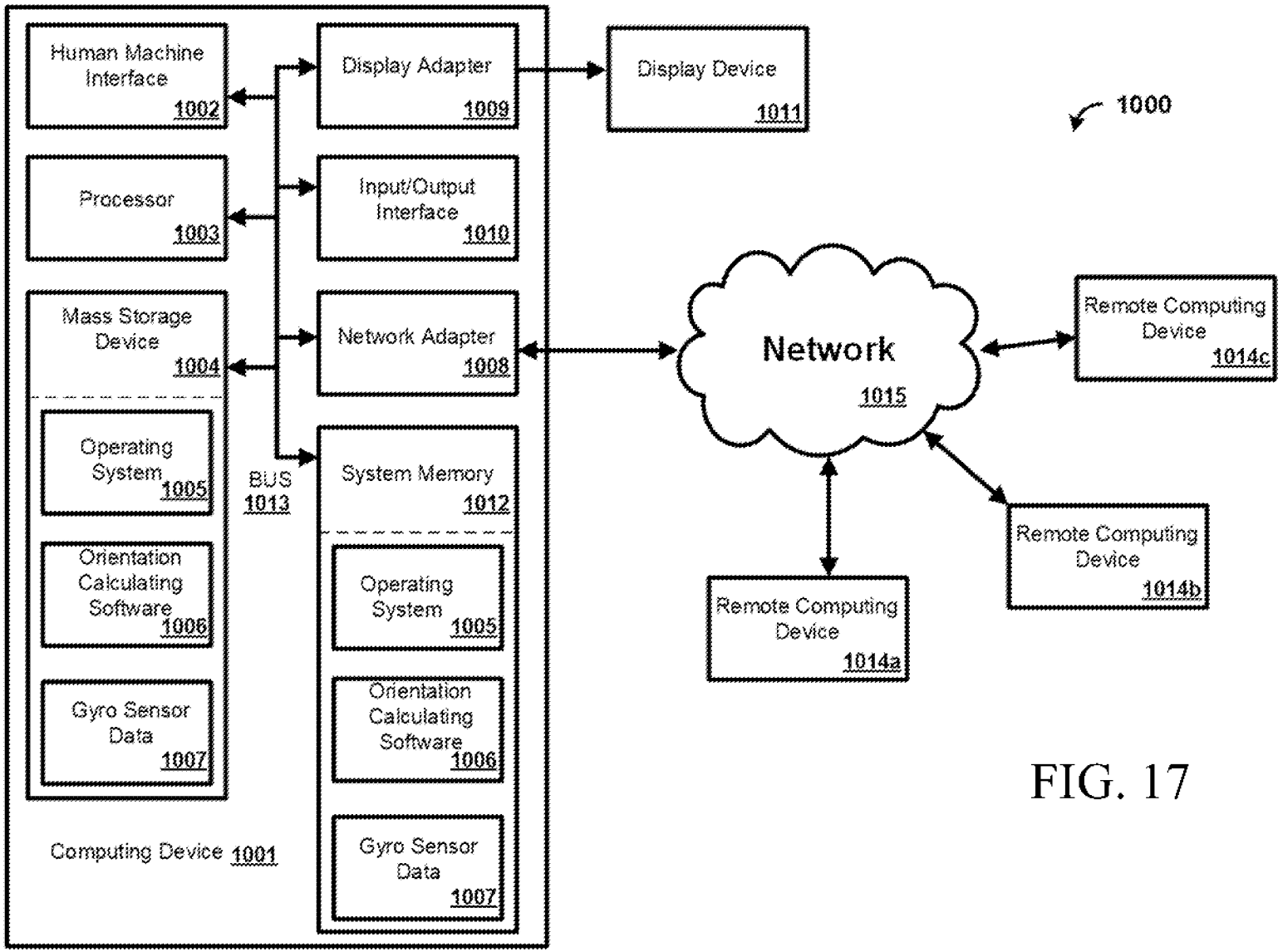
FIG. 17 is a computing system comprising a computing device as disclosed herein.

Referring to FIGS. 14-16 in some aspects, the alignment device 31 can be coupled to a drill rig 100. For example, the alignment device 31 can be coupled to the mounting platform 12 with the mounting platform gripped in a drill string component gripping assembly of a drill rig 100 as further disclosed herein. The drill string gripping assembly can be, for example, a chuck 111 (e.g., of an underground drill rig) or a foot clamp (e.g., of a surface drill rig). Thus, rather than employing a separate mounting assembly or fastener for securing the alignment device to a drill rig or drill rod, the disclosed alignment device can be directly gripped by the standard chuck components of the drill rig, thereby ensuring that the alignment device 31 is in alignment with the drilling axis.

Referring also to FIGS. 1-3, in some aspects, the mounting platform 12 can be integral to the drill rig. In further aspects, the mounting platform 12 can comprise a feature for coupling the mounting platform 12 to the drill rig. For example, in some aspects, the base 20 can comprise a switchable permanent magnet fastener 86. The switchable permanent magnet fastener 86 can comprise a plurality of magnets that are movable about and between a first configuration, in which the polarities of the plurality of magnets align to produce a magnetic attraction to a ferromagnetic surface, and a second configuration, in which the polarities of the plurality of magnets align to at least partially cancel each other out to reduce or eliminate the magnetic attraction of the switchable permanent magnet. The switchable permanent magnet fastener 86 can comprise an actuator 88 (e.g., a lever) that is configured to move at least a portion of the plurality of magnets about and between the first and second configurations. Further details of a switchable permanent magnet fastener in accordance with embodiments disclosed herein is provided in U.S. Pat. No. 7,012,495, issues Mar. 4, 2016, the entirety of which is hereby incorporated by reference herein.

In further aspects, and with reference to FIG. 1, the mounting platform 12 can comprise a gripping surface 90 that is configured to be received within the drill string gripping assembly (e.g., a chuck or foot clamp). The gripping surface 90 can comprise, for example, a cylindrical surface. In further aspects, the gripping surface 90 can have polygonal (e.g., hexagonal, triangular, etc.) cross sections in planes perpendicular to an axis of elongation of the gripping surface 90. It is contemplated that the gripping surface 90 can be parallel to the first longitudinal axis 12. In this way, the orientation of the gripping surface 90 can be related to the first longitudinal axis and, thus, the second longitudinal axis.

In further aspects, the mounting platform 12 can define at least one thread 92 (e.g., at least one male thread or at least one female thread) that is configured to couple to a drill rod 140. For example, the mounting platform 12 can comprise a tubular structure 91 that defines the gripping surface 90 and the at least one thread 92. Thus, the chuck or the foot clamp of the drill rig can couple to the drill rod, and the mounting platform 12 can couple to the drill rod via the at least one thread 92. It is contemplated that at least one thread 92 can have a central axis that is parallel to the first longitudinal axis 12. In this way, the orientation of the at least one thread 92 can be related to the first longitudinal axis and, thus, the second longitudinal axis.

In use, an operator can adjust the orientation of the drill rig based on orientation data from the alignment device.

The chuck can be moved axially along the length of the drilling axis. This can be advantageous when aligning the rig at horizontal to measure changes in the gravity tool face (GTF) and to evaluate the rig for level and/or for twist. As can be understood, GTF can refer to the angular distance of the rotation unit adjustment line with respect to the line passing through the axis of the tool and the high-side tool face. Varying GTF or azimuth along the length of the drilling axis can be associated with a physical issue with the drill rig, such as, for example, a twisted mast or worn guides.

Optionally, the chuck 111 can be moved along the length of the drilling axis when the drilling axis is horizontal or generally horizontal (e.g., within fifteen degrees of horizontal, within ten degrees of horizontal, or within five degrees of horizontal). In this configuration, azimuth can be determined with the drill rig in the lowest possible center of gravity. Further, with the drilling axis oriented horizontally, azimuth can be determined with a high accuracy. In some aspects, after determining azimuth with the drilling axis generally horizontal, and the drill rig can subsequently be repositioned (e.g., raised) into position for drilling along a desired drilling path. With the drill rig properly leveled, the azimuth can remain the same as the measured azimuth in the subsequently repositioned orientation. In some aspects, the alignment device 31 can be used to recheck the alignment once in the subsequently repositioned orientation.

In some aspects, the chuck 111 can rotate the alignment device 180 degrees about the drilling axis. It is contemplated that inherent error of the gyroscopic orientation sensor can be canceled out by collection of data in two orientations offset by 180 degrees. In this way, the alignment device can provide orientation data with greater accuracy.

Exemplary Drill Rig

Disclosed herein, in various aspects and with reference to FIGS. 10-11, is an exemplary drill rig 100 that can use the alignment device 31 (FIG. 1). Optionally, in exemplary applications, the drill rig 100 can be used in underground drilling operations. An exemplary drill rig configuration is described below; however, it is contemplated that any conventional underground drill rig configuration can be used. In exemplary aspects, the drill rig 100 can comprise a feedframe 105 and a first head assembly 110 that is movable on the feedframe 105. The first head assembly 110 can be configured to grip drill rods 140 and casings. The first head assembly 110 can comprise a conventional chuck drive rotation unit (or chuck 111) as is known in the art. One drill rod 140 can be threadedly coupled to additional drill rods 140 to create a drill string 150. In turn, the drill string 150 can be coupled to a drill bit 160 or other in-hole tool configured to interface with the material to be drilled, such as a formation 165 (e.g., an underground formation, such as a rock formation). A core tube assembly 188 (i.e., a core barrel assembly) can be disposed at a distal end of the drill string 150 to receive the material to be drilled (e.g., a core sample).

The feedframe 105 can be oriented such that the drill string 150 is generally horizontal, or oriented upwardly relative to the horizontal, or oriented downwardly relative to the horizontal. The drill rig 100 can thus have a longitudinal drilling axis 180 extending between a front portion 182 and a rear portion 184 of the drill rig 100. Further, the first head assembly 110 is configured to rotate the drill string 150 during a drilling process. In particular, the first head assembly 110 may vary the speed at which the drill string 150 rotates as well as the direction of rotation. The rotational rate of the drill head and/or the torque the first head assembly 110 transmits to the drill string 150 may be selected as desired according to the drilling process. At the front portion 182, the drill rig can comprise a rod holder 172, or foot clamp, that is configured to grip the drill string 150. The drill rig 100 can further comprise a wireline winch 190 that can be used to retract a wireline cable in a conventional manner. Optionally, in use, the wireline cable can be coupled to an overshot to permit retrieval of the overshot. According to at least one aspect, the overshot can be pumped down to engage the core tube assembly 188, and the wireline winch 190 can retract the overshot with the core tube assembly 188 attached thereto. In this way, the drilling system can be used to retrieve core samples. Optionally, the rig 100 can comprise a second head assembly 300 that can be used to couple drill rods to the drill string and provide drilling fluid therethrough.

Referring also to FIG. 12, a drilling system 200 can include the drill rig 100 and a support platform 202, which can optionally include wheels 204 and at least one jack 206 (optionally, a plurality of jacks). Optionally, a rod handler 210 can couple to the platform 202. The rod handler 210 can comprise a moveable arm 212 (e.g., a robotic arm) and a pair of jaws 214 that are coupled to the moveable arm and configured to selectively grab the drill rods 140 to feed to, and remove from, the drill rig 100. In further embodiments, the rod handler 210 can employ switchable magnets (e.g., electromagnets) to selectively grip and release the drill rods 140. In exemplary aspects, the rod handler can have a controller that is operatively coupled to the moveable arm and the pair of jaws. In these aspects, the controller of the rod handler can be communicatively coupled (e.g., via wireless communication) with a computing device, such as a tablet, smartphone, or computer, which can provide control instructions to the controller of the rod handler. Optionally, it is contemplated that the same computing device that controls the rod handler can also receive the output signals from the alignment device. Alternatively, it is contemplated that multiple computing devices can be used.

Optionally, the alignment device 31 can be coupled to a drill rod in axial alignment with said drill rod.

In further aspects, the alignment device 31 can be used for aligning a surface drill rig. Thus, the drill rig 100 can be a surface drill rig having a foot clamp. The alignment device 31 can be gripped by the foot clamp. With the alignment device 31 gripped within the foot clamp, the alignment device can be used to determine azimuth of the drill rig.

It should be understood that although reference is used to the drill string 150 comprising drill rods 140 throughout this disclosure, various other drill string components (e.g., slip subs) could be included as portions of the drill string 150. Moreover, the drilling system 200 can handle such other drill string components in a similar manner (e.g., gripping, threading onto the drill string 150, and removing from the drill string 150).

The Coupling Apparatus as a Wireline Depth Measurement Device

Figure 18:
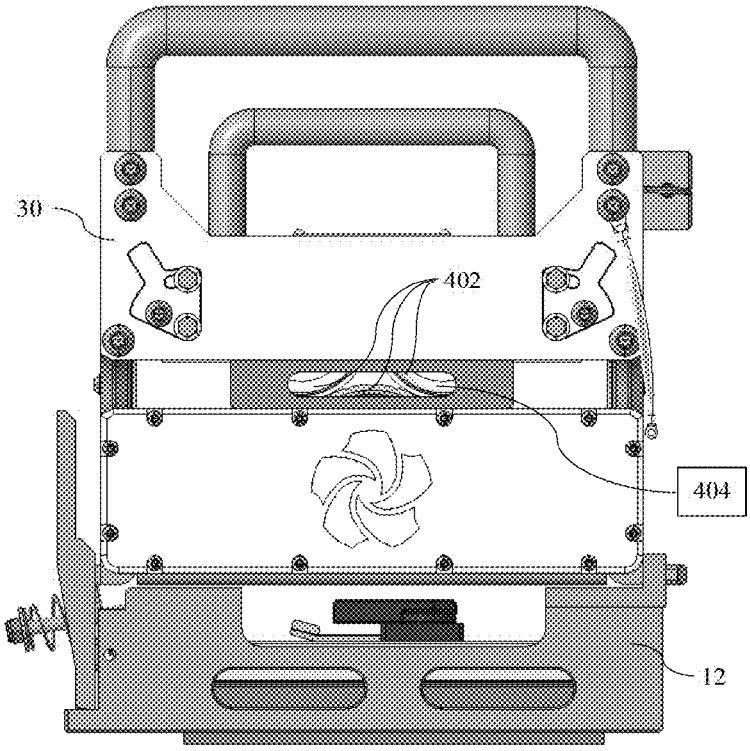
FIG. 18 is a side view of an exemplary coupling apparatus as disclosed herein with a wireline depth measurement unit coupled to a mounting platform.

Referring to FIG. 18, the apparatus 10 can be used to couple a wireline depth measurement device at a borehole. Thus, the unit 30 can comprise the componentry that are typical of conventional wireline devices. For example, the unit 30 can comprise at least two rollers (typically three rollers 402) that are configured to bias against and roll against a wireline cable that is drawn through the unit. An encoder 404 can be coupled to one of the rollers and can be configured to count rotations that can be correlated with the length of the wireline cable that has passed through the unit 30.

Computing Device

Figure 13:
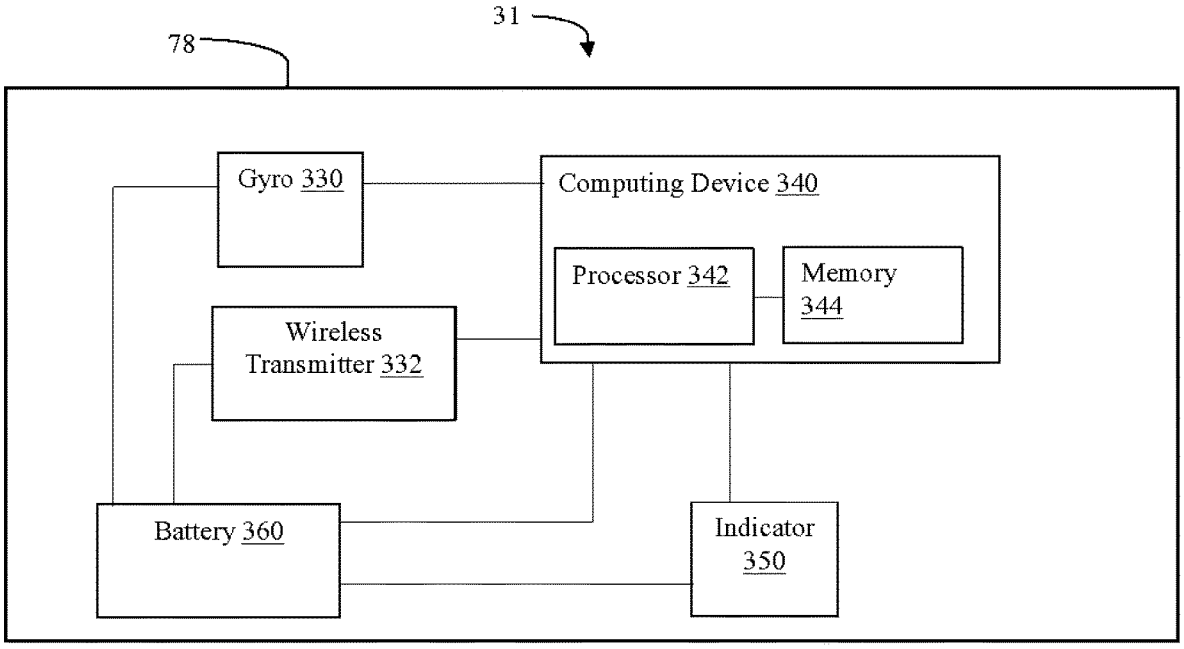
FIG. 13 is a block diagram of a rig alignment device.

FIG. 13 shows an operating environment 1000 including an exemplary configuration of the computing device 1001. The computing device 1001 may comprise one or more processors 1003, a system memory 1012, and a bus 1013 that couples various components of the computing device 1001, including the one or more processors 1003, to the system memory 1012. In the case of multiple processors 1003, the computing device 1001 may utilize parallel computing.

The bus 1013 may comprise one or more of several possible types of bus structures, such as a memory bus, memory controller, a peripheral bus, an accelerated graphics port, and a processor or local bus using any of a variety of bus architectures.

The computing device 1001 may operate on and/or comprise a variety of computer readable media (e.g., non-transitory). Computer readable media may be any available media that is accessible by the computing device 1001 and comprises, non-transitory, volatile and/or non-volatile media, removable and non-removable media. The system memory 1012 has computer readable media in the form of volatile memory, such as random access memory (RAM), and/or non-volatile memory, such as read only memory (ROM). The system memory 1012 may store data such as gyro sensor data 1007 and/or program modules such as operating system 1005 and orientation calculating software 1006 that are accessible to and/or are operated on by the one or more processors 1003.

The computing device 1001 may also comprise other removable/non-removable, volatile/non-volatile computer storage media. The mass storage device 1004 may provide non-volatile storage of computer code, computer readable instructions, data structures, program modules, and other data for the computing device 1001. The mass storage device 1004 may be a hard disk, a removable magnetic disk, a removable optical disk, magnetic cassettes or other magnetic storage devices, flash memory cards, CD-ROM, digital versatile disks (DVD) or other optical storage, random access memories (RAM), read only memories (ROM), electrically erasable programmable read-only memory (EEPROM), and the like.

Any number of program modules may be stored on the mass storage device 1004. An operating system 1005 and orientation calculating software 1006 may be stored on the mass storage device 1004. One or more of the operating system 1005 and orientation calculating software 1006 (or some combination thereof) may comprise program modules and the orientation calculating software 1006. Gyro sensor data 1007 may also be stored on the mass storage device 1004. Gyro sensor data 1007 may be stored in any of one or more databases known in the art. The databases may be centralized or distributed across multiple locations within the network 1015.

A user may enter commands and information into the computing device 1001 using an input device (not shown). Such input devices comprise, but are not limited to, a keyboard, pointing device (e.g., a computer mouse, remote control), a microphone, a joystick, a scanner, a touchscreen, tactile input devices such as gloves, and other body coverings, motion sensor, and the like. These and other input devices may be connected to the one or more processors 1003 using a human machine interface 1002 that is coupled to the bus 1013, but may be connected by other interface and bus structures, such as a parallel port, game port, an IEEE 1394 Port (also known as a Firewire port), a serial port, network adapter 1008, and/or a universal serial bus (USB).

A display device 1011 may also be connected to the bus 1013 using an interface, such as a display adapter 1009. It is contemplated that the computing device 1001 may have more than one display adapter 1009 and the computing device 1001 may have more than one display device 1011. A display device 1011 may be a monitor, an LCD (Liquid Crystal Display), light emitting diode (LED) display, television, smart lens, smart glass, and/or a projector. In addition to the display device 1011, other output peripheral devices may comprise components such as speakers (not shown) and a printer (not shown) which may be connected to the computing device 1001 using Input/Output Interface 1010. Any step and/or result of the methods may be output (or caused to be output) in any form to an output device. Such output may be any form of visual representation, including, but not limited to, textual, graphical, animation, audio, tactile, and the like. The display 1011 and computing device 1001 may be part of one device, or separate devices.

The computing device 1001 may operate in a networked environment using logical connections to one or more remote computing devices 1014*a,b,c*. A remote computing device 1014*a,b,c* may be a personal computer, computing station (e.g., workstation), portable computer (e.g., laptop, mobile phone, tablet device), smart device (e.g., smartphone, smart watch, activity tracker, smart apparel, smart accessory), security and/or monitoring device, a server, a router, a network computer, a peer device, edge device or other common network node, and so on. Logical connections between the computing device 1001 and a remote computing device 1014*a,b,c* may be made using a network 1015, such as a local area network (LAN) and/or a general wide area network (WAN). Such network connections may be through a network adapter 1008. A network adapter 1008 may be implemented in both wired and wireless environments. Such networking environments are conventional and commonplace in dwellings, offices, enterprise-wide computer networks, intranets, and the Internet. It is contemplated that the remote computing devices 1014*a,b,c* can optionally have some or all of the components disclosed as being part of computing device 1001. In further optional aspects, the remote computing device 1014*b* can be a server that receives and stores logged data from the alignment device. In optional aspects, some or all data processing can be performed via cloud computing on a computing device or system that is remote to the computing device 1001.

Application programs and other executable program components such as the operating system 1005 are shown herein as discrete blocks, although it is recognized that such programs and components may reside at various times in different storage components of the computing device 1001, and are executed by the one or more processors 1003 of the computing device 1001. An implementation of orientation calculating software 1006 may be stored on or sent across some form of computer readable media. Any of the disclosed methods may be performed by processor-executable instructions embodied on computer readable media.

Exemplary Aspects

In view of the described devices, systems, and methods and variations thereof, herein below are described certain more particularly described aspects of the invention. These particularly recited aspects should not however be interpreted to have any limiting effect on any different claims containing different or more general teachings described herein, or that the "particular" aspects are somehow limited in some way other than the inherent meanings of the language literally used therein.

Aspect 1: An apparatus comprising:

a mounting platform having a first longitudinal axis, the mounting platform comprising:

a base defining a first coupling feature;

a latch that is movably coupled to the base about and between a secured position and a release position, wherein the latch defines a first retention feature;

a unit that is attachable to the mounting platform, the unit having a second longitudinal axis, the unit comprising:

a second coupling feature that extends along the second longitudinal axis, wherein the second coupling feature is configured for engagement with the first coupling feature by movement of the second coupling feature relative to the first coupling feature along the first longitudinal axis, wherein engagement between the first and second coupling features is configured to inhibit movement of the second coupling feature relative to the first coupling feature along an axis that is perpendicular to the first longitudinal axis; and a second retention feature that is configured to cooperate with the first retention feature to inhibit movement of the second retention relative to the first retention feature along the axis that is perpendicular to the first longitudinal axis.

Aspect 2: The apparatus of aspect 1, wherein the first coupling feature is a receptacle, wherein the second coupling feature is a first protrusion that is receivable into the first receptacle.

Aspect 3: The apparatus of aspect 1 or aspect 2, wherein the first retention feature comprises a second receptacle, wherein the second retention feature comprises a second protrusion that is receivable into the second receptacle.

Aspect 4: The apparatus of any one of the preceding aspects, wherein the latch is pivotably coupled to the base about and between the secured position and the release position.

Aspect 5: The apparatus of any one of the preceding aspects, further comprising a locking pin that is configured to retain the latch in the secured position.

Aspect 6: The apparatus of any one of the preceding aspects, wherein the mounting platform further comprises a biasing element that biases the latch toward the secured position.

Aspect 7: The apparatus of aspect 6, wherein the biasing element comprises a spring.

Aspect 8: The apparatus of any one of the preceding aspects, wherein the first protrusion and the second retention feature define a maximum spacing, wherein, with the latch in the release position, the first receptacle and the second retention feature define a removal spacing, wherein the maximum spacing between the first protrusion and the second retention feature is greater than the removal spacing.

Aspect 9: The apparatus of any one of the preceding aspects, wherein movement of the latch from the secured position to the release position moves the first retention feature along the first longitudinal axis by a release distance, wherein with the latch in the secured position, the first and second coupling features extend past each other by an overlap distance along the first longitudinal axis, wherein the overlap distance is greater than the release distance.

Aspect 10: The apparatus of aspect 9, wherein the first coupling feature is a receptacle, wherein the second coupling feature is a first protrusion that is receivable into the first receptacle wherein the first protrusion has a protrusion distance along the second longitudinal axis, wherein the protrusion distance is greater than the release distance.

Aspect 11: The apparatus of any one of the preceding aspects, wherein the first receptacle comprises opposing first and second surfaces, wherein the first surface forms an acute angle with the first longitudinal axis.

Aspect 12: The apparatus of any one of the preceding aspects, wherein the first coupling feature is a receptacle, wherein the second coupling feature is a first protrusion that is receivable into the first receptacle, wherein the first receptacle is a through-opening that extends between opposed first and second surfaces of a body, wherein the opposed first and second surfaces of the body are spaced along the first longitudinal axis by a first receptacle depth, wherein the first protrusion has a protrusion distance along the second longitudinal axis, wherein the protrusion distance is greater than the first receptacle depth.

Aspect 13: The apparatus of any one of the preceding aspects, wherein the first receptacle comprises opposing first and second surfaces, wherein the first and second surfaces increase in spacing from each other moving along the first longitudinal axis in a direction from the first retention feature to the first receptacle.

Aspect 14: The apparatus of any one of the preceding aspects, wherein the first coupling feature is a receptacle, wherein the second coupling feature is a first protrusion that is receivable into the first receptacle, wherein the first receptacle comprises opposing first and second surfaces, wherein the base further comprises an alignment pin that extends between the opposed first and second surfaces, wherein the first protrusion comprises spaced prongs that are configured to receive the alignment pin therebetween to align the first longitudinal axis with the second longitudinal axis.

Aspect 15: The apparatus of any one of the preceding aspects, wherein the unit comprises at least one sensor that is configured to provide a signal indicative of an orientation of the alignment device.

Aspect 16: The apparatus of aspect 15, wherein the at least one sensor comprises a gyroscopic orientation sensor.

Aspect 17: The apparatus of any one of the preceding aspects, wherein the base further comprises a gripping surface that is configured to be received within a chuck.

Aspect 18: The apparatus of aspect 17, wherein the gripping surface is a cylindrical surface.

Aspect 19: The apparatus of any one of the preceding aspects, wherein the base further comprises a switchable permanent magnet fastener.

Aspect 20: The apparatus of any one of the preceding aspects, wherein the base is integral to a drill rig.

Aspect 21: The apparatus of any one of aspects 1-14, wherein the unit further comprises:

at least one wheel that is configured to bias against a wireline cable and rotate as the wireline cable moves along the wheel; and an encoder that is configured to determine an amount of rotational movement of the wheel.

Aspect 22: A method of using the apparatus as in aspect 16 to orient a drill rig, the drill rig having a drilling axis, the method comprising:

providing, using the gyroscopic orientation sensor of the unit, a signal indicative of an orientation of the unit with the unit coupled to the mounting platform and the mounting platform coupled to the drill rig.

Aspect 23: The method of aspect 22, wherein the mounting platform is coupled to the drill rig.

Aspect 24: The method of aspect 23, wherein the base of the mounting platform comprises a switchable permanent magnet fastener, wherein mounting platform is coupled to the drill rig by the switchable permanent magnet fastener.

Aspect 25: The method of aspect 22, wherein a portion of the mounting platform is gripped by a chuck of the drill rig.

Aspect 26: The method of any one of aspects 22-25, wherein the first coupling feature is a receptacle, wherein the second coupling feature is a first protrusion that is receivable into the first receptacle, the method further comprising:

moving the latch to the release position; and removing the first protrusion of the unit from the first receptacle of the base of the mounting platform.

Aspect 27: The method of any one of aspects 22-25, wherein the first coupling feature is a receptacle, wherein the second coupling feature is a first protrusion that is receivable into the first receptacle, the method further comprising:

inserting, prior to providing, using the gyroscopic orientation sensor of the unit, the signal indicative of the orientation of the unit, the first protrusion of the unit into the first receptacle of the base of the mounting platform; and pivoting the unit to engage the second retention feature of the unit with the first retention feature of the latch.

Aspect 28: A method of using the apparatus of aspect 21, the method comprising:

detecting, by the encoder, movement of a wireline cable along the at least one wheel with the mounting platform coupled to a drill string and the unit coupled to the mounting platform.

Aspect 29: A system comprising:

a drill rig;

an apparatus as in any one of aspects 1-20, wherein the mounting platform is coupled to the drill rig.

Aspect 30: A system comprising:

a drill string;

a wireline cable that is configured to move within a drill string; and an apparatus as in aspect 21, wherein the mounting platform is coupled to the drill string, wherein the unit is coupled to the mounting platform, wherein the at least one wheel is biased against the wireline cable.

Although the foregoing invention has been described in some detail by way of illustration and example for purposes of clarity of understanding, certain changes and modifications may be practiced within the scope of the appended claims.

What is claimed is:

1. An apparatus comprising:

a mounting platform having a first longitudinal axis, the mounting platform comprising:

a base defining a first coupling feature; and a latch that is movably coupled to the base about and between a secured position and a release position, wherein the latch defines a first retention feature;

an alignment device that is attachable to the mounting platform in known alignment with the mounting platform, alignment device having a second longitudinal axis, the alignment device comprising:

a second coupling feature that extends along the second longitudinal axis, wherein the second coupling feature is configured for engagement with the first coupling feature by movement of the second coupling feature relative to the first coupling feature along the first longitudinal axis, wherein engagement between the first and second coupling features is configured to inhibit movement of the second coupling feature relative to the first coupling feature along an axis that is perpendicular to the first longitudinal axis;

a second retention feature that is configured to cooperate with the first retention feature to inhibit movement of the second retention relative to the first retention feature along the axis that is perpendicular to the first longitudinal axis; and at least one sensor that is configured to provide a signal indicative of an orientation of the alignment device.

2. The apparatus of claim 1, wherein the first coupling feature is a first receptacle, wherein the second coupling feature is a first protrusion that is receivable into the first receptacle.

3. The apparatus of claim 1, wherein the first retention feature comprises a second receptacle, wherein the second retention feature comprises a second protrusion that is receivable into the second receptacle.

4. The apparatus of any claim 1, wherein the latch is pivotably coupled to the base about and between the secured position and the release position.

5. The apparatus of claim 1, wherein the first coupling feature is a first receptacle, wherein the second coupling feature is a first protrusion that is receivable into the first receptacle, wherein the first receptacle comprises opposing first and second surfaces, wherein the base further comprises an alignment pin that extends between the opposed first and second surfaces, wherein the first protrusion comprises spaced prongs that are configured to receive the alignment pin therebetween to align the first longitudinal axis with the second longitudinal axis.

6. The apparatus of claim 1, wherein the at least one sensor comprises a gyroscopic orientation sensor.

7. A method of using the apparatus as in claim 6 to orient a drill rig, the drill rig having a drilling axis, the method comprising:

providing, using the gyroscopic orientation sensor of the alignment device, a signal indicative of an orientation of the alignment device with the alignment device coupled to the mounting platform and the mounting platform coupled to the drill rig.

8. The method of claim 7, wherein the mounting platform is threading coupled to a drill rod that is gripped by a chuck of the drill rig.

9. The method of claim 8, wherein the base of the mounting platform comprises a switchable permanent magnet fastener, wherein mounting platform is coupled to the drill rig by the switchable permanent magnet fastener.

10. The method of claim 7, wherein a portion of the mounting platform is gripped by a chuck of the drill rig.

11. The method of claim 7, wherein the first coupling feature is a first receptacle, wherein the second coupling feature is a first protrusion that is receivable into the first receptacle, the method further comprising:

moving the latch to the release position; and removing the first protrusion of the alignment device from the first receptacle of the base of the mounting platform.

12. The method of claim 7, wherein the first coupling feature is a first receptacle, wherein the second coupling feature is a first protrusion that is receivable into the first receptacle, the method further comprising:

inserting, prior to providing, using the gyroscopic orientation sensor of the alignment device, the signal indicative of the orientation of the alignment device, the first protrusion of the alignment device into the first receptacle of the base of the mounting platform; and pivoting the alignment device to engage the second retention feature of the alignment device with the first retention feature of the latch.

13. The apparatus of claim 1, wherein the base further comprises a gripping surface that is configured to be received within a chuck.

14. The apparatus of claim 13, wherein the gripping surface is a cylindrical surface.

15. The apparatus of claim 1, wherein the base further comprises a switchable permanent magnet fastener.

16. The apparatus of claim 1, wherein the base is integral to a drill rig.

17. The apparatus of claim 1, wherein the alignment device further comprises:

at least one roller that is configured to bias against a wireline cable and rotate as the wireline cable moves along the roller; and an encoder that is configured to determine an amount of rotational movement of the roller.

18. A method of using the apparatus of claim 17, the method comprising:

detecting, by the encoder, movement of a wireline cable along the at least one roller with the mounting platform coupled to a drill string and the alignment device coupled to the mounting platform.

19. A system comprising:

a drill string;

a wireline cable that is configured to move within a drill string; and the apparatus as in claim 17, wherein the mounting platform is coupled to the drill string, wherein the alignment device is coupled to the mounting platform, wherein the at least one roller is biased against the wireline cable.

20. A system comprising:

a drill rig;

the apparatus as in claim 1, wherein the mounting platform is coupled to the drill rig.

* * * * *